US007307610B2

(12) United States Patent
Sakaguchi

(10) Patent No.: US 7,307,610 B2
(45) Date of Patent: Dec. 11, 2007

(54) DISPLAY DRIVING DEVICE AND DISPLAY USING THE SAME

(75) Inventor: Nobuhisa Sakaguchi, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 366 days.

(21) Appl. No.: 10/421,712

(22) Filed: Apr. 24, 2003

(65) Prior Publication Data

US 2003/0201959 A1 Oct. 30, 2003

(30) Foreign Application Priority Data

Apr. 25, 2002 (JP) ..... 2002-125028

(51) Int. Cl.
*G09G 3/36* (2006.01)
*G09G 5/10* (2006.01)

(52) U.S. Cl. ..... 345/89; 345/211; 345/690; 345/100

(58) Field of Classification Search ..... 345/690, 345/211, 60–102
See application file for complete search history.

(56) References Cited

U.S. PATENT DOCUMENTS

| | | | | |
|---|---|---|---|---|
| 6,373,419 | B1 | 4/2002 | Nakao | |
| 6,762,565 | B2 * | 7/2004 | Kudo et al. | 315/169.2 |
| 2002/0135575 | A1 * | 9/2002 | Mizuno | 345/211 |
| 2002/0186230 | A1 * | 12/2002 | Kudo et al. | 345/690 |

FOREIGN PATENT DOCUMENTS

JP 2001-022325 A 1/2001

OTHER PUBLICATIONS

Korean Office Action issued on May 31, 2005 and English translation thereof.

* cited by examiner

*Primary Examiner*—Duc Dinh
(74) *Attorney, Agent, or Firm*—Harness, Dickey & Pierce, P.L.C.

(57) ABSTRACT

A display driving device includes: a tone voltage generating circuit generating as many standard voltages as tones; and a DA converter circuit selecting one of the standard voltages in accordance with display data and outputting the selected standard voltage, and applies a tone display voltage to data signal lines of an active matrix scheme display panel. In the tone voltage generating circuit are there provided: a resistance dividing circuit generating as many standard voltages as tones, the standard voltages having voltage values between an upper limit voltage and a lower limit voltage; and an adjusting circuit generating the upper limit voltage and the lower limit voltage. A reference voltage regulated by an electronic volume control provided externally to the tone voltage generating circuit is supplied to the adjusting circuit, and both the upper limit voltage and the lower limit voltage are varied in accordance with the reference voltage. This makes it possible to provide a display driving device, as well as a display using it, which readily allows for changes in γ characteristics in accordance with the characteristics of the liquid crystal material and the liquid crystal panel without additional manufacturing cost.

23 Claims, 21 Drawing Sheets

FIG. 21

(a)

FIRST FRAME

| ROW \ COLUMN | 1 | 2 | 3 | 4 | 5 |
|---|---|---|---|---|---|
| 1 | + | + | + | + | + |
| 2 | − | − | − | − | − |
| 3 | + | + | + | + | + |
| 4 | − | − | − | − | − |
| 5 | + | + | + | + | + |
| 6 | − | − | − | − | − |

(b)

NEXT FRAME

| ROW \ COLUMN | 1 | 2 | 3 | 4 | 5 |
|---|---|---|---|---|---|
| 1 | − | − | − | − | − |
| 2 | + | + | + | + | + |
| 3 | − | − | − | − | − |
| 4 | + | + | + | + | + |
| 5 | − | − | − | − | − |
| 6 | + | + | + | + | + |

DISPLAY DRIVING DEVICE AND DISPLAY USING THE SAME

FIELD OF THE INVENTION

The present invention relates to display driving devices which drive active matrix liquid crystal panels, EL (electroluminescent) panels, and other display panels, and displays using the same.

BACKGROUND OF THE INVENTION

Among various display schemes for liquid crystal displays, EL displays, and like matrix displays, one that achieves a high definition display is an active matrix scheme using TFTs (Thin Film Transistors) as switching elements.

A TFT-based liquid crystal display will be described as a typical example of the active matrix display in reference to FIG. 13 showing a block diagram of its construction. The display and its display scheme constitute related art to this invention.

The liquid crystal display is formed of a liquid crystal display section and a liquid crystal drive device which drives the display section. The liquid crystal display section includes a TFT liquid crystal panel 901.

The liquid crystal panel 901 is provided in it with liquid crystal display elements (not shown) and an opposite electrode (common electrode) 907. Meanwhile, the liquid crystal drive device includes: a source drive circuit 902A composed of source drivers 902 each built around an IC (Integrated Circuit); a gate drive circuit 903A composed of gate drivers 903 each built around an IC; a controller 904; a liquid crystal drive power source 905; and an opposite electrode drive circuit 906 which controls the electric potential of the opposite electrode 907.

The source driver 902 and the gate driver 903 are typically constructed (packaged) either by connecting a wired insulating film with an IC chip mounted thereon, for example, a TCP (Tape Carrier Package), to ITO (Indium Tin Oxide) or other terminals of the liquid crystal panel 901 or by thermally compressing a bare IC chip to ITO or other terminals of the liquid crystal panel 901 with an intervening ACF (anisotropic conductive film). FIG. 13 illustrates the construction by way of functions of individual components.

The controller 904 supplies digitized display data (for example, RGB signals representing red, green, and blue colors) D and various control signals to the source drivers 902 and various control signals to the gate drivers 903. Primary control signals fed to the source drivers 902, collectively designated S1 in the figure, include a horizontal synchronization signal (latch signal), a source driver start pulse signal, and a source driver clock signal. Primary control signals fed to the gate drivers 903, collectively designated S2 in the figure, include a vertical synchronization signal and a gate driver clock signal. A power source which drives the IC chips is omitted in the figure.

The liquid crystal drive power source 905 supplies voltage (e.g., reference voltage VR which will be detailed later) for liquid crystal panel display to the source drivers 902 and the gate drivers 903.

The display data, externally fed, is supplied to the source drivers 902 through the controller 904 as the display data D in the form of a digital signal.

The source drivers 902 latch the display data D from the controller 904 by time division and convert the display data D from digital to analog in synchronism with the horizontal synchronization signal (alternatively, "latch signal LS" (see FIG. 14)) from the controller 904. The source drivers 902 then supply a tone display analog voltage (tone display voltage, data signal) obtained by the DA conversion from liquid crystal drive voltage output terminals to the liquid crystal display elements (not shown), in the liquid crystal panel 901, associated with the liquid crystal drive voltage output terminals via source signal lines (data signal lines; not shown). The gate drivers 903 supply a scan signal to gate signal lines (scan signal lines; not shown) to select a gate signal line.

FIG. 14 shows a block diagram of the construction of the source drivers 902. The following description deals only with basics. Although nothing will be mentioned here about the source driver 902 in the last stage, it is arranged identically to those in the other stages which will be described, except that the former does not output a cascade output signal S.

Each source driver 902 includes an input latch circuit 1011, a shift register circuit 1012, a sampling memory circuit 1013, a hold memory circuit 1014, a level shifter circuit 1015, a DA converter circuit 1016, an output circuit 1017, and a standard voltage generating circuit 1019.

The display data (digital signal) DR, DG, DB (for example, 6 bit each) fed from the controller 904 is temporarily latched in the input latch circuit 1011. The display data DR, DG, DB corresponds to red, green, and blue.

Meanwhile, the start pulse signal SP controlling the transfer of the display data DR, DG, DB is transferred in the shift register circuit 1012 in synchronism with a clock signal CK, and output as an output signal S from the stages (flip-flops) in the shift register circuit 1012 to the sampling memory circuit 1013 and also as a cascade output signal S (start pulse signal SP for the source driver 902 in a next stage) from the last stage in the shift register circuit 1012 to the source driver 902 in a next stage.

The display data DR, DG, DB latched by the previous input latch circuit 1011 in synchronism with the output signals from the stages in the shift register circuit 1012 is temporarily stored in the sampling memory circuit 1013 by time division and output to the next hold memory circuit 1014.

As the sampling memory circuit 1013 holds display data for one horizontal synchronization period, the hold memory circuit 1014 acquires an output signal from the sampling memory circuit 1013 in accordance with the horizontal synchronization signal (latch signal LS), outputs the signal to the next level shifter circuit 1015, and holds the display data until it is fed with a next horizontal synchronization signal.

The level shifter circuit 1015 is to convert the level of the output signal (display data) from the hold memory circuit 1014 by, for example, stepping it up, to a level within a such range that the signal can be appropriately converted in a DA converter circuit 1016 in a next stage to an application voltage (analog voltage) to the liquid crystal panel 901.

The standard voltage generating circuit 1019 generates as many analog voltages for tone display as tones in accordance with a reference voltage VR from the liquid crystal drive power source 905 (see FIG. 13) for output to the DA converter circuit 1016.

The DA converter circuit 1016 selects an analog voltage from the analog voltages (tone display voltages), as many as the tones, supplied by the standard voltage generating circuit 1019 in accordance with the display data level-converted by the level shifter circuit 1015. The analog voltage representing a tone display is fed from the liquid crystal drive voltage output terminals (hereinafter, simply "output terminals") 1018 to the source signal lines of the liquid crystal panel 901 via the output circuit 1017.

The output circuit 1017 is basically a buffer circuit and built around, for example, a voltage follower circuit using a differential amplifier circuit.

Next, the standard voltage generating circuit 1019 and the DA converter circuit 1016 will be described in terms of circuit construction in more detail which is especially relevant to the present invention.

FIG. 15 shows a circuit diagram of a construction example of the standard voltage generating circuit 1019 as related art. Assuming that digital display data contains, for example, 6 bits for each of RGB (18-bit color), the standard voltage generating circuit 1019 outputs 64 analog voltages $V_0$-$V_{63}$ which correspond to a display of $2^6$=64 tones. The following will describe a specific construction.

The standard voltage generating circuit 1019, in its simplest form, is built around a resistance dividing circuit in which resistors $R_0$-$R_7$ are connected in series.

Each resistor $R_0$-$R_7$ is 8 resistive elements connected in series. Taking the resistor $R_0$ as an example, it is formed by 8 resistive elements $R_{01}$, $R_{02}$, . . . $R_{08}$ connected in series as shown in FIG. 16.

The remaining resistors $R_1$-$R_7$ are also formed by 8 resistive elements connected in series, identically to the resistor $R_0$. Therefore, the whole standard voltage generating circuit 1019 is formed by 64 resistive elements connected in series.

The standard voltage generating circuit 1019 has 9 halftone voltage input terminals, one for each of 9 reference voltages $V'_0$, $V'_8$, . . . $V'_{56}$, and $V'_{64}$. The resistor $R_0$ is connected at an end thereof to a halftone voltage input terminal corresponding to the reference voltage $V'_{64}$ and at its other end, that is, the connection between the resistor $R_0$ and the resistor $R_1$, to a halftone voltage input terminal corresponding to the reference voltage $V'_{56}$.

Similarly, halftone voltage input terminals corresponding to the reference voltages $V'_{48}$, $V'_{40}$, . . . $V'_8$ are connected respectively to the connections between adjacent ones of the resistors $R_1$, $R_2$, $R_3$, $R_4$, . . . , $R_6$, and $R_7$. The resistor $R_7$ is connected at an end thereof opposite the connection with the resistor $R_6$ to a halftone voltage input terminal corresponding to the reference voltage $V'_0$.

The construction makes available the voltages $V_1$-$V_{63}$ appearing at the nodes between adjacent ones of the 64 resistive elements and the voltage $V_0$ obtained straightly from the reference voltage $V'_0$, in other words, a total of 64 tone display analog voltages $V_0$-$V_{63}$. In short, the standard voltage generating circuit 1019, if constructed from resistance dividing circuits, supplies the voltages (tone display analog voltages) $V_0$-$V_{63}$ to the DA converter circuit 1016.

Incidentally, in typical situations, the halftone voltage input terminals at both ends are always fed with the reference voltages $V'_0$ and $V'_{64}$ respectively. Meanwhile, the 7 halftone voltage input terminals corresponding to remaining $V'_8$-$V'_{56}$ are used for fine adjustment and may not actually be fed with voltage.

Next, the DA converter circuit 1016 will be described. FIG. 17 shows a construction example of the DA converter circuit 1016 as related art. In the figure, 1017 represents the aforementioned output circuit and is built around a voltage follower circuit here.

In the DA converter circuit 1016, analog switches are laid out so as to select and output one of the 64 incoming voltages $V_0$-$V_{63}$ in accordance with display data represented by a 6-bit digital signal. That is, the analog switches are turned on/off in accordance with each bit (Bit0 to Bit5) of display data represented by a 6-bit digital signal. Thus, one of the 64 incoming voltages is selected and output to the output circuit 1017. The analog switch is constructed from, for example, a MOS (metal oxide semiconductor) transistor or transmission gate.

The following will describe the layout of the analog switches.

According to the 6-bit digital signal (display data), Bit0 is the least significant bit (LSB), and Bit5 is the most significant bit (MSB). The analog switches (hereinafter, simply, "switches") are arranged in pairs. 32 switch pairs (64 switches) are assigned to Bit0, and 16 switch pairs (32 switches) are assigned to Bit1.

Similarly, assigned switching pairs are reduced in half in number for each higher bit, until a single switch pair (2 switches) are assigned to Bit5. Therefore, in total, there are involved $2^5+2^4+2^3+2^2+2^1+1=63$ switch pairs (126 switches).

An end of each switch assigned to Bit0 form a terminal where a previous voltage $V_0$-$V_{63}$ is fed. The other end of the switch is paired with such an end of another switch, both ends being connected to an end of a switch assigned to next Bit1. The same arrangement is repeated all the way down to the switch assigned to Bit5, where a line is drawn from the switch assigned to Bit5 and connects to the output circuit 1017.

The switch groups assigned to Bit0 to Bit5 will be referred to as the switch groups $SW_0$-$SW_5$ respectively. The switches in the switch groups $SW_0$-$SW_5$ are controlled through the 6-bit digital signal (display data) Bit0 to Bit5 as in the following. In the switch groups $SW_0$-$SW_5$, one of the paired analog switches (the lower switch in the figure) is in the "on" state when the corresponding bit is a 0 (LOW). Conversely, the other analog switch (the upper switch in the figure) is in the "on" state when the corresponding bit is a 1 (HIGH).

The figure shows Bit0 to Bit5 representing "111111" with the upper switch in each pair in the "on" state and the lower switch in the "off" state. The DA converter circuit 1016 is supplying the voltage $V_{63}$ to the output circuit 1017.

Similarly, the DA converter circuit 1016 supplies to the output circuit 1017, for example, the voltage $V_{62}$ when Bit0 to Bit5 are "111110," the voltage $V_1$ when "000001," and the voltage $V_0$ when "000000." One of the tone display analog voltages $V_0$-$V_{63}$ in accordance with a digital display is thus selected to effect a tone display.

Typically, each source driver IC has one standard voltage generating circuit 1019 which is shared for use among multiple output terminals. In contrast, one DA converter circuit 1016 and one output circuit 1017 are provided to each output terminal 1018.

In a color display, a different output terminal 1018 is used for each color, in which case, each DA converter circuit 1016 and output circuit 1017 are used for a different pixel and for a different color.

In other words, supposing that the liquid crystal panel 901 has N pixels in the longitudinal direction (horizontal line direction) and that the output terminals 1018 are denoted by R, G, B (respectively representing red, green, blue colors the terminals are assigned to) and suffixes n (n=1, 2, . . . , N), the output terminals 1018 are designated R1, G1, B1, R2, G2, B2, . . . , RN, GN, BN. This means that 3N DA converter circuits 1016 and output circuits 1017 are needed.

A liquid crystal device of the aforementioned type is disclosed in Japanese patent application publication Tokukai 2000-183747 (published on Jun. 30, 2000) which is a counterpart to the U.S. Pat. No. 6,373,419.

Incidentally, to effect a natural tone display on an actual liquid crystal display of related art, differences are adjusted between the light transmittance properties of the liquid crystal material and man's visual traits by γ correction. In γ correction, the standard voltage generating circuit 1019 typically generates various tone display analog voltage values by dividing internal resistance unequally rather than equally.

FIG. 18 shows a relationship between tone display data (digital display data) and liquid crystal drive output voltages (tone display analog voltage) of the related art after γ correction. As shown in the figure, zigzag line properties are imparted to the tone display analog voltage with respect to digital display data.

To realize the properties, in the standard voltage generating circuit 1019 in FIG. 15, each resistor $R_0, \ldots, R_7$ is internally divided into 8 identical parts, and has such a resistance value that will realize the aforementioned γ correction.

In other words, the γ correction is effected by specifying, for example, the 8 resistive elements $R_{01}, R_{02}, \ldots, R_{08}$ connected in series forming the resistor $R_0$ to have equal resistance values, and changing the ratio of the resistance values of the resistors $R_0, R_1, \ldots, R_7$ each composed of 8 resistive elements so that the ratio effects the γ correction.

The liquid crystal panel 901 is alternatingly driven (driven by AC) to prevent liquid crystal polarization. There are two types of reversal drive schemes: "dot-reversal drive scheme" and "line-reversal drive scheme."The following description will assume that the liquid crystal panel 901 has 6-row by 5-column pixels (picture elements) and driven by 6 gate signal lines and 5 source signal lines.

First, as related art, the liquid crystal display constructed as above will be described in terms of operation when it is driven by line-reversal drive scheme.

FIG. 19 is a timing chart showing scan signals S11*a*-S11*f* applied respectively to the 6 gate signal lines from the gate drivers 903 in the liquid crystal display as related art.

FIG. 20 is a timing chart showing, in the liquid crystal display as related art, any one scan signal S11 of the aforementioned scan signals S11*a*-S11*f* one data signal S12 of those applied to the 5 source signal lines from the source drivers 902, and an opposite electrode drive voltage S13 applied to the opposite electrode 907.

Now, FIGS. 19, 20 will be described collectively.

The scan signals S11*a*-S11*f* are HIGH only during a predetermined single horizontal synchronization period WH in each predetermined frame display period CH and LOW during the rest of the period. The scan signals S11*a*-S11*f* are HIGH at different times in each horizontal synchronization period. Therefore, the aforementioned voltages to be held in the pixels are written to the pixels in a row of pixels on one of the gate signal lines when the scan signal on that gate signal line is HIGH. A "row of pixels on a gate signal line" refers to a set of pixels having pixel electrodes connected to respective drain terminals of TFTs of which the gate terminals are in turn connected to the gate signal line.

The AC component of the opposite electrode drive voltage S13 applied to the opposite electrode 907 has a cycle equal to the horizontal period WH. In other words, in line-reversal drive scheme, normally, the opposite electrode 907 is AC driven at the same cycle as the horizontal period WH by a single constant voltage (5 V) power supply, and its electric potential (opposite electrode drive voltage S13) varies between the power source voltage level (5 V) and the GND voltage level (0 V).

Centered with respect to the amplitude center of the AC component of the opposite electrode drive voltage S13 applied to the opposite electrode 907, the AC component of the data signal S12 (the output of the source drivers 902) varies at a predetermined cycle less than, or equal to, the horizontal period WH. The amplitude of the AC component of the data signal S12 varies in accordance with the pixel tone. The AC component of the data signal S12*a* when the pixel tone is maximum, that is, the pixel is made to appear black, and the AC component of the data signal S12*b* when the pixel tone is minimum, that is, the pixel is made to appear white, have the same amplitude, but of opposite polarity.

The amplitudes of the data signals S12*a* and S12*b* when the pixel tone is maximum and minimum are both smaller than the amplitude of the AC component of the opposite electrode drive voltage S13 applied to the opposite electrode 907.

The arrows S14*a*, S14*b* indicate the polarity of the electric current flow through the pixel to write the aforementioned voltage to be held in the pixel, in other words, how much greater or smaller the voltage S12*b* to be held by the source signal line is than the voltage (opposite electrode drive voltage S13) held by the opposite electrode 907 when the aforementioned voltage to be held in the pixel is written to the pixel.

The arrows S14*a*, S14*b*, if pointing upwards, indicate that the voltage of the source signal line (data line) is higher than the center voltage (S13) of the opposite electrode 907; therefore the polarity of the electric current flow through the pixel is positive. If they are pointing downwards, it indicates that the voltage of the source signal line is lower than the center voltage (S13) of the opposite electrode 907; therefore, the polarity of the electric current flow through the pixel is negative. When the polarity of the electric current flow through the pixel is positive, the electric current flows from the source signal line, passes through the pixel, and travels on toward the opposite electrode 907. When the polarity of the electric current flow through the pixel is negative, the electric current flows from the opposite electrode 907, passes through the pixel, and travels on toward the source signal line.

"(a)" in FIG. 21 shows the polarities of the electric currents through all the pixels to write the aforementioned voltages to be held in the pixels to all the pixels in the liquid crystal panel 901 in a certain frame (suppose the first frame) when the liquid crystal display is driven by line-reversal drive scheme.

"(b)" in FIG. 21 shows the polarities of the electric current through all the pixels in a subsequent frame to the frame in (a) in FIG. 21 under the same conditions. The rectangles laid out in matrix represent the respective 6-row by 5-column pixels in the liquid crystal panel 901. A row of rectangles represents a row of pixels. A column of rectangles represents a column of pixels, that is, a set of all pixels having pixel electrodes connected to a source signal line via TFTs. When the polarity of the electric current flow through the pixel is positive, "+" (positive polarity) is written in the rectangle representing the pixel; when the polarity is negative, "−" (negative polarity) is written in that rectangle.

So far was a description of a drive device to produce a tone display using a TFT scheme liquid crystal display.

Incidentally, liquid crystal displays have been developed in response to demands for increased screen size to find ways to television and personal computer display market. Meanwhile, recent rapid market expansion of mobile telephones and game machines has created demands for more mobile-oriented liquid crystal displays and liquid crystal drive devices mounted thereto.

Basically, liquid crystal displays and liquid crystal drive devices must have compact screens to be suitable for such use in mobile terminals. Therefore, for that use, liquid crystal drive devices are also strongly required to be compact, lightweight, and low power consuming (for longer battery life), as well as to improve display quality and reduce cost.

However, the conventional standard voltage generating circuit 1019 have following problems. Optimal γ correction is performed (the zigzag line properties of the liquid crystal drive output voltage in FIG. 18) varies depending on the pixel count in the liquid crystal panel 901 and the type of liquid crystal material, hence from one liquid crystal display to another. Besides, the resistance division ratio of the standard voltage generating circuit 1019 built in the source driver 902 is determined in designing the source driver 902.

Therefore, if γ correction characteristics are to be changed in accordance with the type of chosen liquid crystal material in the liquid crystal panel 1 and the pixel count in the liquid crystal panel 1, the source driver 902 must be remade every time such a change occurs. This is a problem.

As a method of changing γ correction characteristics of related art, a method is conceivable which adjusts reference voltages (halftone voltages) supplied to the halftone voltage input terminals $V'_0$-$V'_{64}$ of the standard voltage generating circuit 902. However, the aforementioned adjusting method results in increased terminal counts and circuit size, and resultant added manufacturing cost. This is another problem.

SUMMARY OF THE INVENTION

In view of the problems of related art, the present invention has an objective to provide a display driving device and a display using the same which readily allows change in γ correction characteristics within a γ correction value voltage range in accordance with characteristics of a liquid crystal material and a liquid crystal panel without additional manufacturing cost.

To achieve the objective, a display driving device of the present invention is a display driving device for applying, to data signal lines of an active matrix display panel, a tone display voltage inverted in polarity at a predetermined cycle and modulated in accordance with display data, and is characterized in that it includes:

a tone voltage generator for generating as many standard voltages as tones; and a digital-to-analog converter for selecting one of the standard voltages in accordance with display data and outputting the selected standard voltage as a tone display voltage, the tone voltage generator including:

a standard voltage generator for generating as many standard voltages as tones the standard voltages having voltage values between an upper limit voltage and a lower limit voltage; and an upper/lower limit voltage generator for generating the upper limit voltage and the lower limit voltage, wherein the upper/lower limit voltage generator is arranged to be fed with an input voltage regulated by an external voltage regulator and to vary both the upper limit voltage and the lower limit voltage in accordance with an identical input voltage.

According to the arrangement, by adjusting the input voltage using the external voltage regulator, the γ characteristics of the display (display brightness characteristics of the display panel in relation to the brightness value of in the display data) can be readily adjusted in accordance with the characteristics of the display panel (liquid crystal material and liquid crystal panel) without bothering to remake the display driving device.

Further, according to the arrangement, the generation of the upper limit voltage and the lower limit voltage is adjustable based on a common external voltage; the externally supplied voltage is small, compared to cases where the upper limit voltage and the lower limit voltage are separately adjusted are externally supplied to a standard voltage generator. The arrangement can be simplified, and the γ characteristics adjusting job becomes easy.

A display of the present invention, in order to achieve the objective, is characterized in that it includes a display driving device of any one of the arrangements; and an active matrix display panel including data signal lines to which data signal is input from the display driving device; and a voltage regulator supplying the input voltage to the display driving device and being capable of adjusting the input voltage.

According to the arrangement, by adjusting the input voltage using the voltage regulator, the γ characteristics of the display can be readily adjusted in accordance with the characteristics of the display panel (liquid crystal material and liquid crystal panel) without bothering to remake the display driving device.

According to the arrangement, both the upper limit voltage and the lower limit voltage are adjustable by only adjusting the input voltage using the voltage regulator; the arrangement can be simplified and the γ characteristics adjusting job becomes easy, compared to cases where there is provided a voltage regulator separately adjusting the upper limit voltage and the lower limit voltage.

For a fuller understanding of the nature and advantages of the invention, reference should be made to the ensuing detailed description taken in conjunction with the accompanying drawings.

BRIEF DESCRIPTION OF THE DRAWINGS

FIG. 21 is a drawing showing the polarities of electric currents through pixels in a two consecutive frames when the liquid crystal display is driven by line-reversal drive scheme, FIG. 21 showing the polarities of electric currents through pixels in a certain frame (shown as (a)) and the polarities of electric currents through pixels in a succeeding frame (shown as (b)) to the certain frame (shown as (a)).

DESCRIPTION OF THE EMBODIMENTS

Embodiment 1

The following will describe an embodiment in accordance with the present invention in reference with FIG. 1 through FIG. 9.

Figure 2:
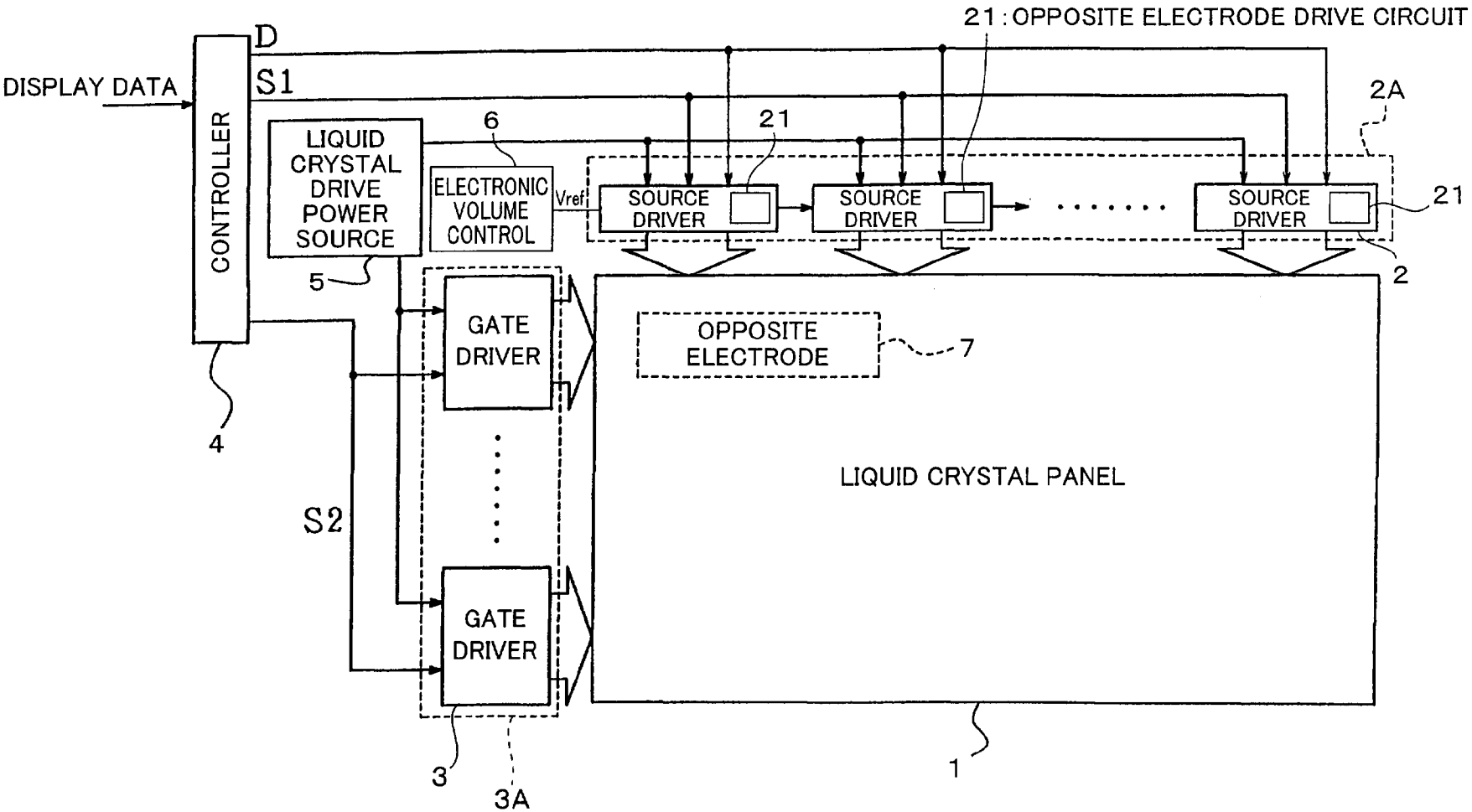
FIG. 2 is a block diagram schematically showing an arrangement of a liquid crystal display of an embodiment in accordance with the present invention.
Figure 13:
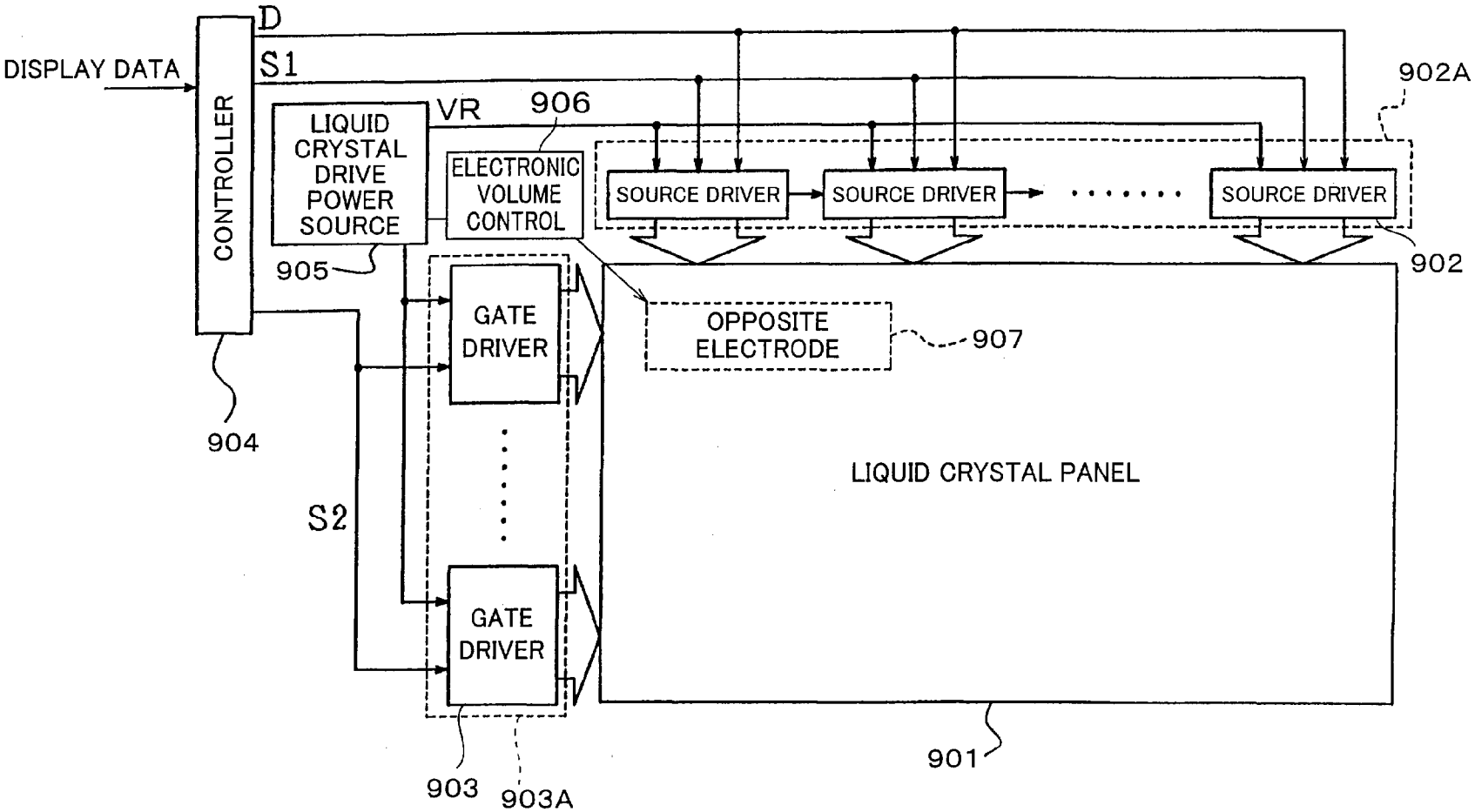
FIG. 13 shows a schematic block arrangement example of a liquid crystal display in related art.
Figure 14:
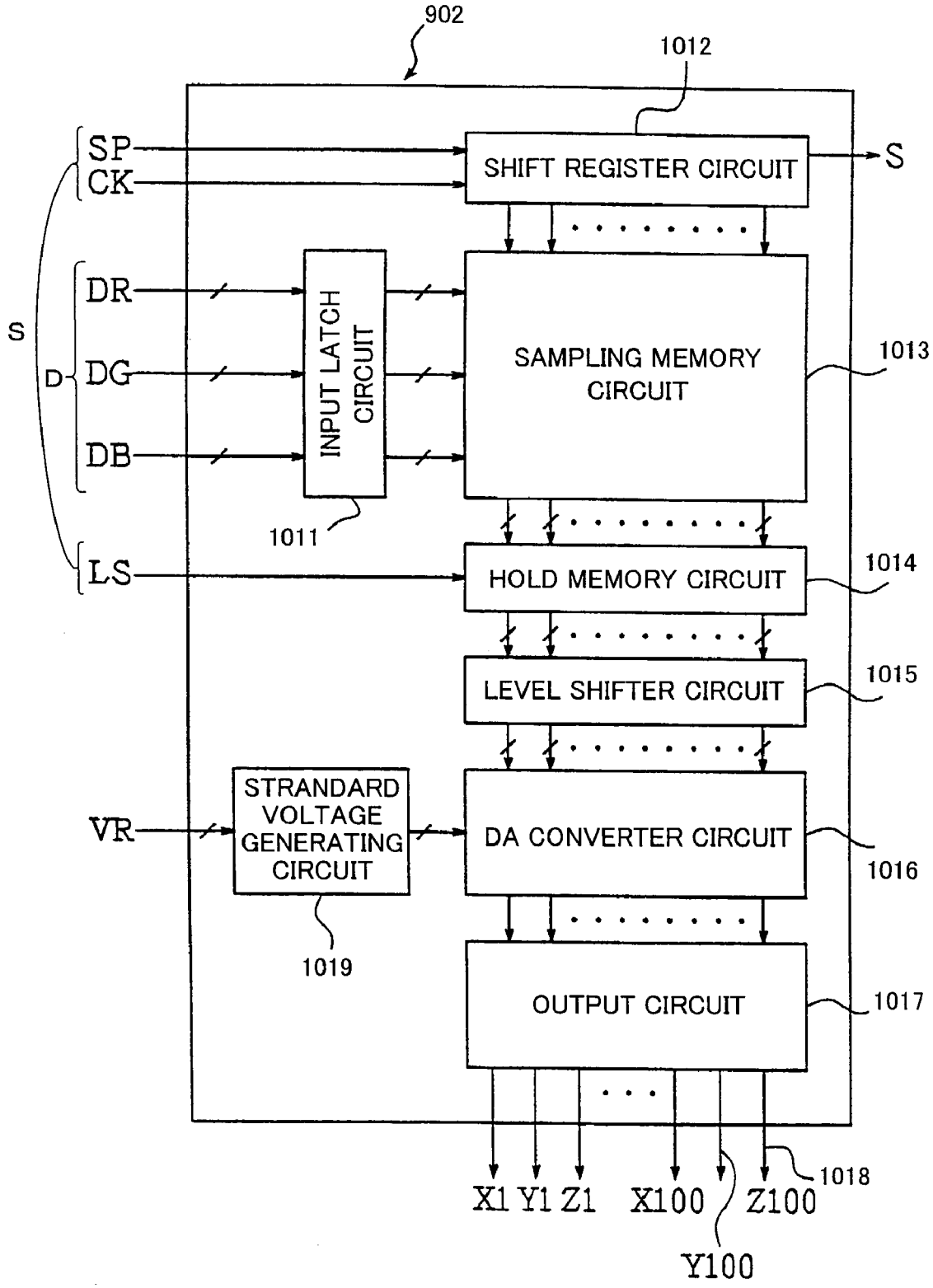
FIG. 14 is a block diagram schematically showing an arrangement of a source driver in related art.

FIG. 2 shows a block arrangement of a liquid crystal display of a TFT (thin film transistor) type which is a typical example of the active matrix scheme. The liquid crystal display is arranged from a liquid crystal display section and a liquid crystal drive device driving it, similarly to the aforementioned related art in reference to FIG. 13. The liquid crystal display section includes a TFT liquid crystal panel (display panel) 1.

The liquid crystal panel 1 includes therein a liquid crystal display element (not shown) and a opposite electrode (common electrode) 7. Meanwhile, the liquid crystal drive circuit includes: a source drive circuit 2A composed of source drivers 2 as display driving devices; a gate drive circuit 3A composed of gate drivers 3; a controller 4; a liquid crystal drive power source 5; an electronic volume control (voltage regulator) 6 disposed externally to the source drivers 2; and an opposite electrode drive circuit 21 for the control of the electric potential of the opposite electrode 7.

The source drivers 2 and gate drivers 3 are typically composed of an IC chip whose terminals are connected to source signal lines, gate signal lines, and other terminal sections made of ITO or an other transparent conductor on the liquid crystal panel 1 to form a package. They are typically packaged by one of the following methods: (1) A TCP (tape carrier package) or circuit substrate composed of the IC chip mounted on a wired substrate fabricated by forming wiring on an insulating film is packaged and connected to the source signal lines, gate signal lines, and other terminal sections on the liquid crystal panel 1. (2) The IC chip is thermally compressed, and thus packaged and connected directly to the source signal lines, gate signal lines, and other terminal sections on the liquid crystal panel 1 with an intervening ACF (anisotropic conductive film).

In the present embodiment, to further scale down the liquid crystal display, the opposite electrode drive circuit 21 is provided in the source driver 2, and integrated in one IC chip together with those circuit components which drive the source signal lines (input latch circuit 12, a shift register circuit 13, a sampling memory circuit 14, a hold memory circuit 15, a level shifter circuit 16, a tone voltage generating circuit 17, a DA converter circuit 18, an output circuit 19, and a selector circuit 20 which will be described later). This makes the present embodiment capable of providing a liquid crystal drive circuit and a liquid crystal drive device using it which can accommodate further reduction of the liquid crystal display in size.

The controller 4 supplies digitized display data (for example, RGB signals representing red, green, and blue colors) D and various control signals to the source drivers 2 and various control signals to gate drivers 3. Primary control signals fed to the source drivers 2, collectively designated S1 in the figure, include a horizontal synchronization signal (latch signal), a source driver start pulse signal, and a source driver clock signal. Primary control signals fed to the gate drivers 3, collectively designated S2 in the figure, include a vertical synchronization signal and a gate driver clock signal. A power source which drives the IC chips is omitted in the figure.

The liquid crystal drive power source 5 supplies, to the source drivers 2 and the gate drivers 3, voltage (power source voltage VCC and opposite electrode drive voltage Vcom which will be detailed later) for tone display on the liquid crystal panel 1.

The display data, externally fed, is supplied to the source drivers 2 through the controller 4 as the display data D in the form of a digital signal.

The source drivers 2 latch the display data D from the controller 4 by time division and convert the display data D from digital to analog in synchronism with the horizontal synchronization signal (alternatively, "latch signal LS" (see FIG. 3)) from the controller 4. The source drivers 2 then supply a tone display analog voltage (tone display voltage ; data signal) obtained by the DA conversion from the liquid crystal drive voltage output terminals to the liquid crystal display element (not shown), in the liquid crystal panel 1, associated with the liquid crystal drive voltage output terminals via the source signal lines (data signal lines; detailed later) 34. The gate drivers 3 supply a scan signal to gate signal lines (scan signal lines; detailed later) 35 to select a gate signal line 35 (detailed later).

Figure 3:
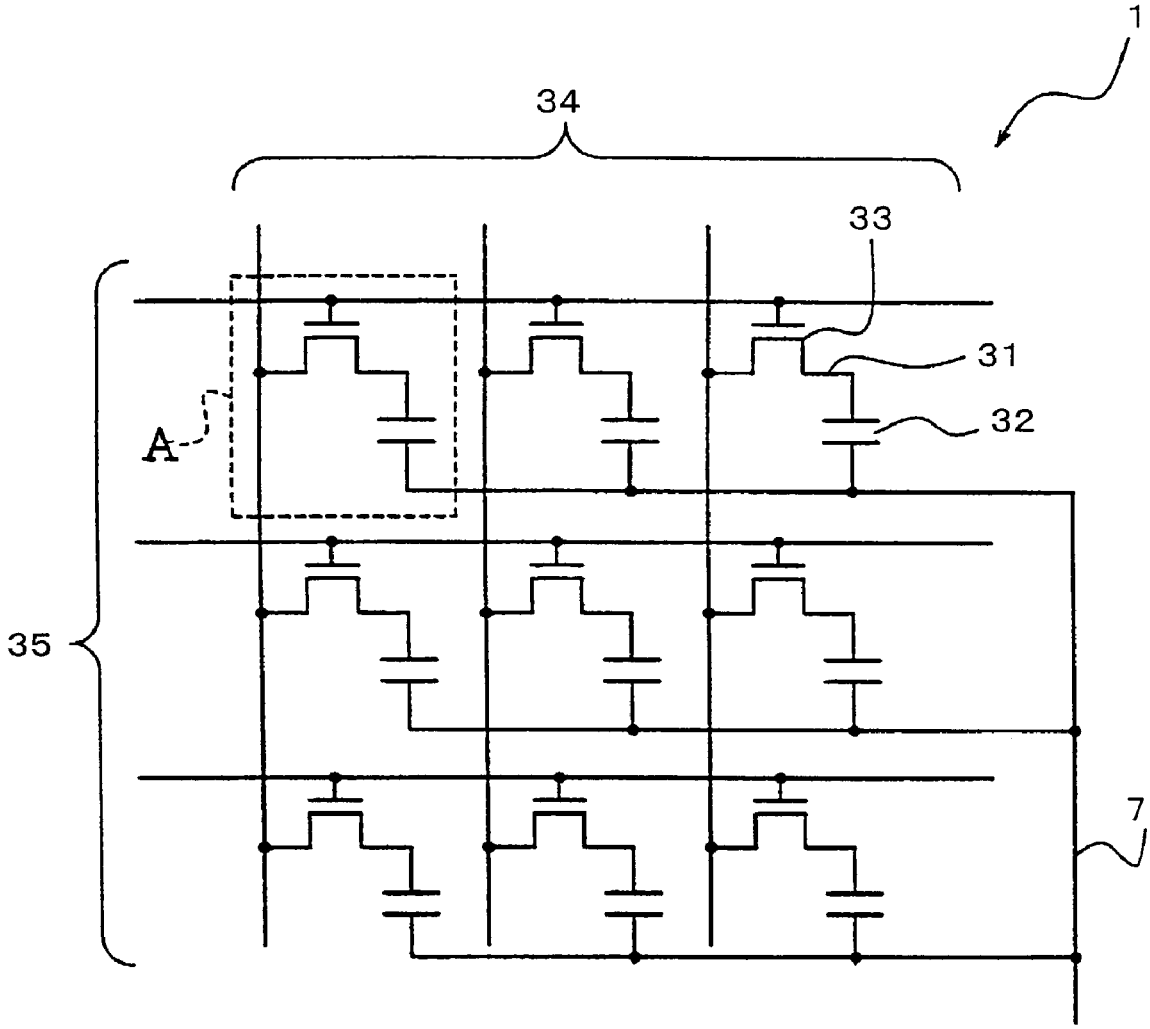
FIG. 3 is a circuit diagram schematically showing an arrangement of a liquid crystal panel of an embodiment in accordance with the present invention.

Now, the liquid crystal panel 1 will be described in reference to FIG. 3 showing its arrangement.

The liquid crystal panel 1 is provided with pixel electrodes 31, pixel capacitors 32 which are liquid crystal, TFTs 33 as switching elements which turn on/off voltage application to the pixel capacitors 32, source signal lines (data signal lines) 34, gate signal lines 35, and an opposite electrode 7. The area designated A in the figure is a pixel, that is, a liquid crystal display element for one pixel.

The source signal lines 34 are fed with tone display voltages (source signals, data signals) matched with the brightness of the target display pixels from the source drivers 2. The gate signal lines 35 are fed with a scan signal (gate signal) from the gate drivers 3 so as to turn on the columns of the TFTs 33 column by column.

When the tone display voltage on the source signal line 34 is applied to the pixel electrode 31 connected to the drain of an ON-state TFT 33 the pixel capacitor 32 between that pixel electrode 31 and the opposite electrode 7 charges and thus changes the light transmittance of the liquid crystal (pixel capacitor 32) in accordance with the tone display voltage to effect a display.

Figure 4:
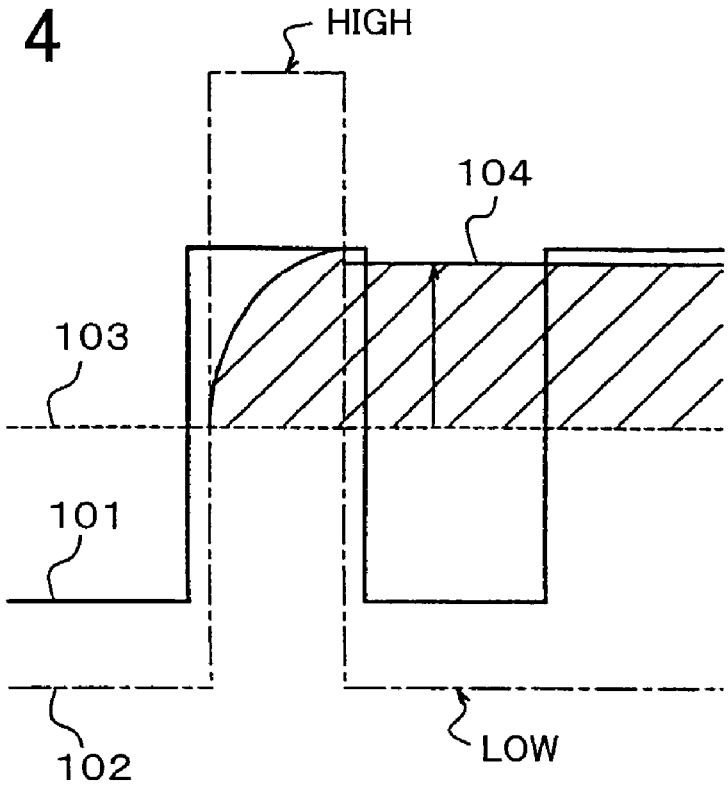
FIG. 4 shows an example of a liquid crystal driving waveform in a liquid crystal display.
Figure 5:
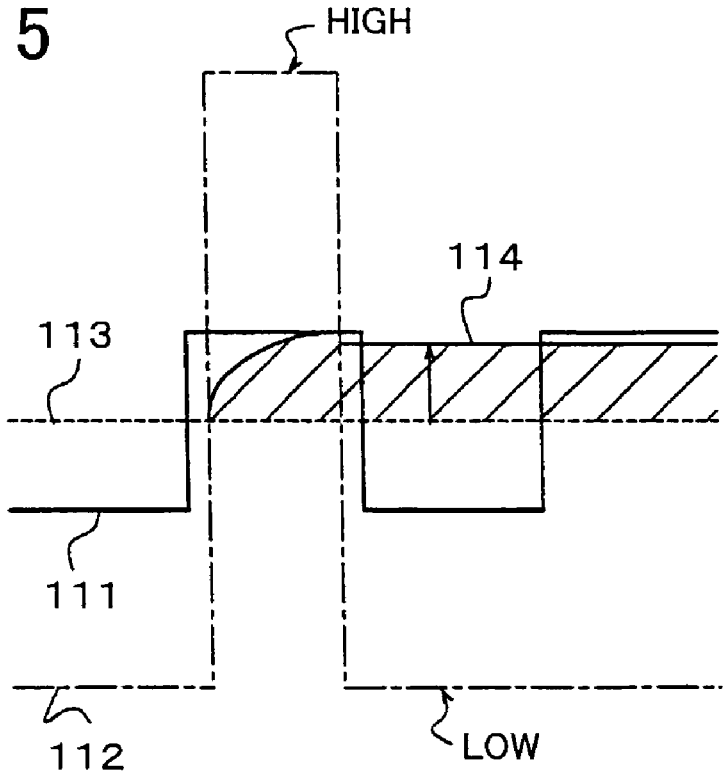
FIG. 5 shows an another example of a liquid crystal driving waveform in a liquid crystal display.

FIG. 4 and FIG. 5 show an example of the waveform of a liquid crystal drive signal. In these figures, 101, 111 refer to the waveforms of output signals (tone display voltages) from the source driver 2; 102, 112 refer to the waveforms of output signals (scan signals) from the gate driver 3; 103, 113 refer to the waveforms of the potential of the opposite electrode 7; and 104, 114 refer to the waveforms of the potential of the pixel electrode 31. The voltage applied to the liquid crystal (pixel capacitors 32) is the difference in electric potential between the pixel electrode 31 and the opposite electrode 7, which is shown by hatches in the figure.

For example, in FIG. 4, the TFT 33 turns on when the output signal from the gate driver 3 represented by the waveform 102, is HIGH, applying to the pixel capacitor 32 the difference between the output signal from the source driver 2 represented by the driving waveform 101 and the potential 103 of the opposite electrode 7. Thereafter, the output signal from the gate driver 3 represented by the driving waveform 102 goes LOW, turning off the TFT 33. Under these circumstances, since the pixel capacitor 32 holds electric charge, the potential of the pixel electrode 31 is maintained at the value when turned on (the potential of the output signal from the source driver 2 represented by driving waveform 111), and the voltage applied to the liquid crystal (pixel capacitor 32) remains unchanged. The same description applies to FIG. 5.

FIGS. 4, 5 show differing voltages being applied to the liquid crystal, the applied voltage being higher in the former than in the latter. In this manner, by varying the voltage applied to the liquid crystal as an analog voltage, the light transmittance of the liquid crystal is changed in an analog fashion to effect a multitone display. The number of tones that can be displayed is determined by the number of analog voltages applied to the liquid crystal.

The following will focus on the source driver 2 to further describe the liquid crystal drive device, because the present invention relates to a tone display standard voltage generating circuit ("tone voltage generating circuit") and an opposite electrode drive circuit 8 in the source driver 2 which are especially large in size and high in power consumption in the liquid crystal drive device for tone display.

Figure 6:
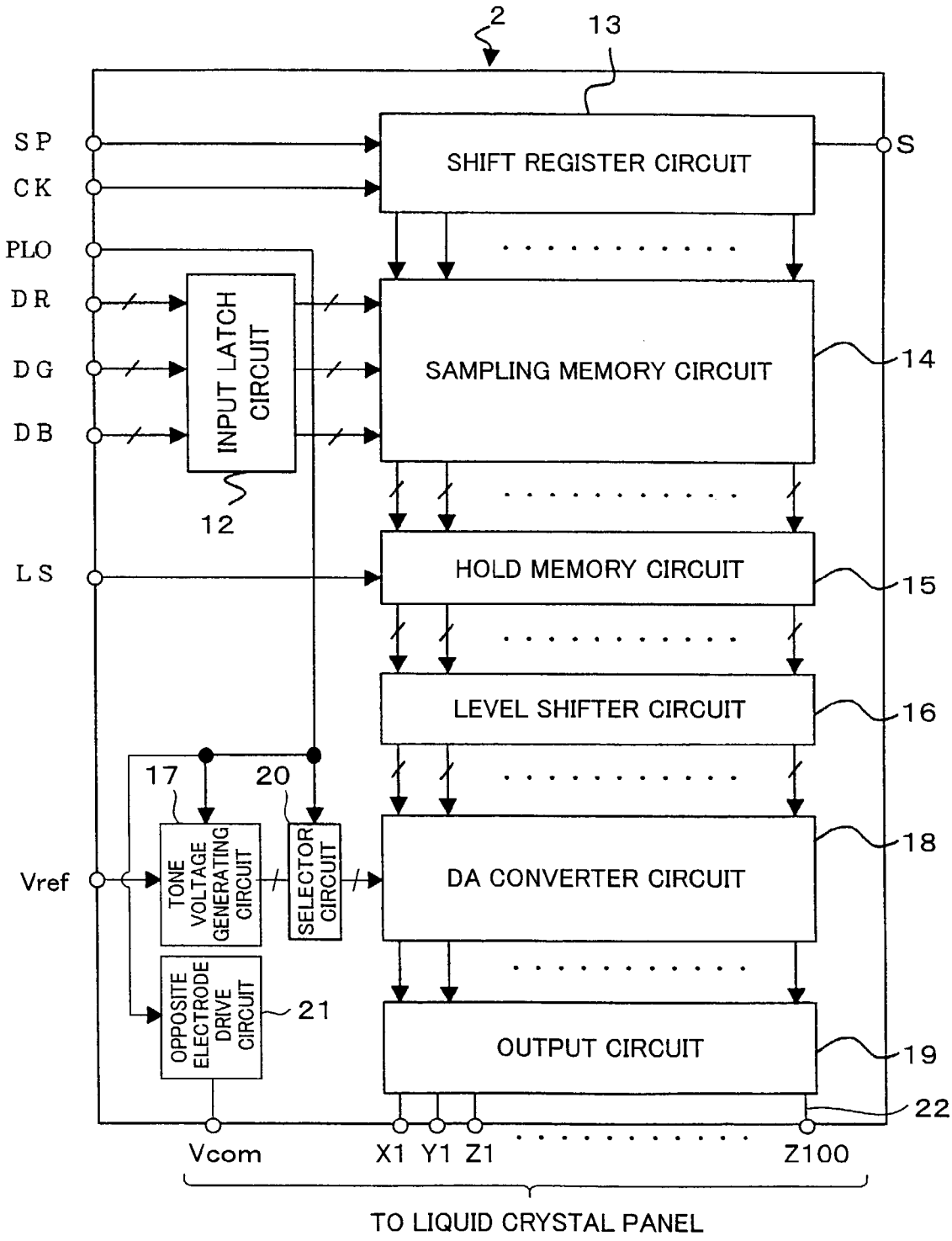
FIG. 6 is a block diagram of schematically showing an arrangement of a source driver of an embodiment in accordance with the present invention.

FIG. 6 schematically shows an arrangement of the source driver 2 as an embodiment of the liquid crystal drive device in accordance with the present invention. The source driver 2 is arranged from an input latch circuit 12, a shift register circuit 13, a sampling memory circuit 14, a hold memory circuit 15, a level shifter circuit 16, a tone voltage generating circuit (tone voltage generator) 17, a DA converter circuit (digital-to-analog converter) 18, an output circuit 19, a selector circuit 20, and an opposite electrode drive circuit 21.

The display data D composed of digital display data DR, DG, DB (for example, 6 bits each) transferred from the controller 4 (see FIG. 2) is temporarily latched by the input latch circuit 12. The digital display data DR, DG, DB correspond to red, green, and blue respectively.

Meanwhile, the start pulse signal SP controlling the transfer of the digital display data DR, DG, DB is transferred through the shift register circuit 13 in synchronism with the clock signal CK and output from stages (flip-flops) of the shift register circuit 13 to the sampling memory circuit 14 as output signals S, as well as from the last stage of the shift register circuit 13 to a next-stage source driver 2 as a cascade output signal S (start pulse signal SP for a next-stage source driver 2).

In synchronism with the output signals from the stages of the shift register circuit 13, the digital display data DR, DG, DB latched by the previous input latch circuit 12 is temporarily stored in the sampling memory circuit 14 by time division and fed to the next hold memory circuit 15, When display data for one horizontal synchronization period (display data corresponding to the pixels on one horizontal line (one gate line) of the display panel) is stored in the sampling memory circuit 14, the hold memory circuit 15 acquires an output signal from the sampling memory circuit 14 and outputs it to the next level shifter circuit 16 in accordance with the horizontal synchronization signal (latch signal LS), and holds that display data until a next horizontal synchronization signal is input.

The level shifter circuit 16 is provided to convert the level of the output signal (display data) form the hold memory circuit 15 by, for example, stepping it up, to a level within such a range that the signal can be appropriately converted in the DA converter circuit 18 in a next stage to an application voltage (analog voltage) to the liquid crystal panel 1.

Figure 1:
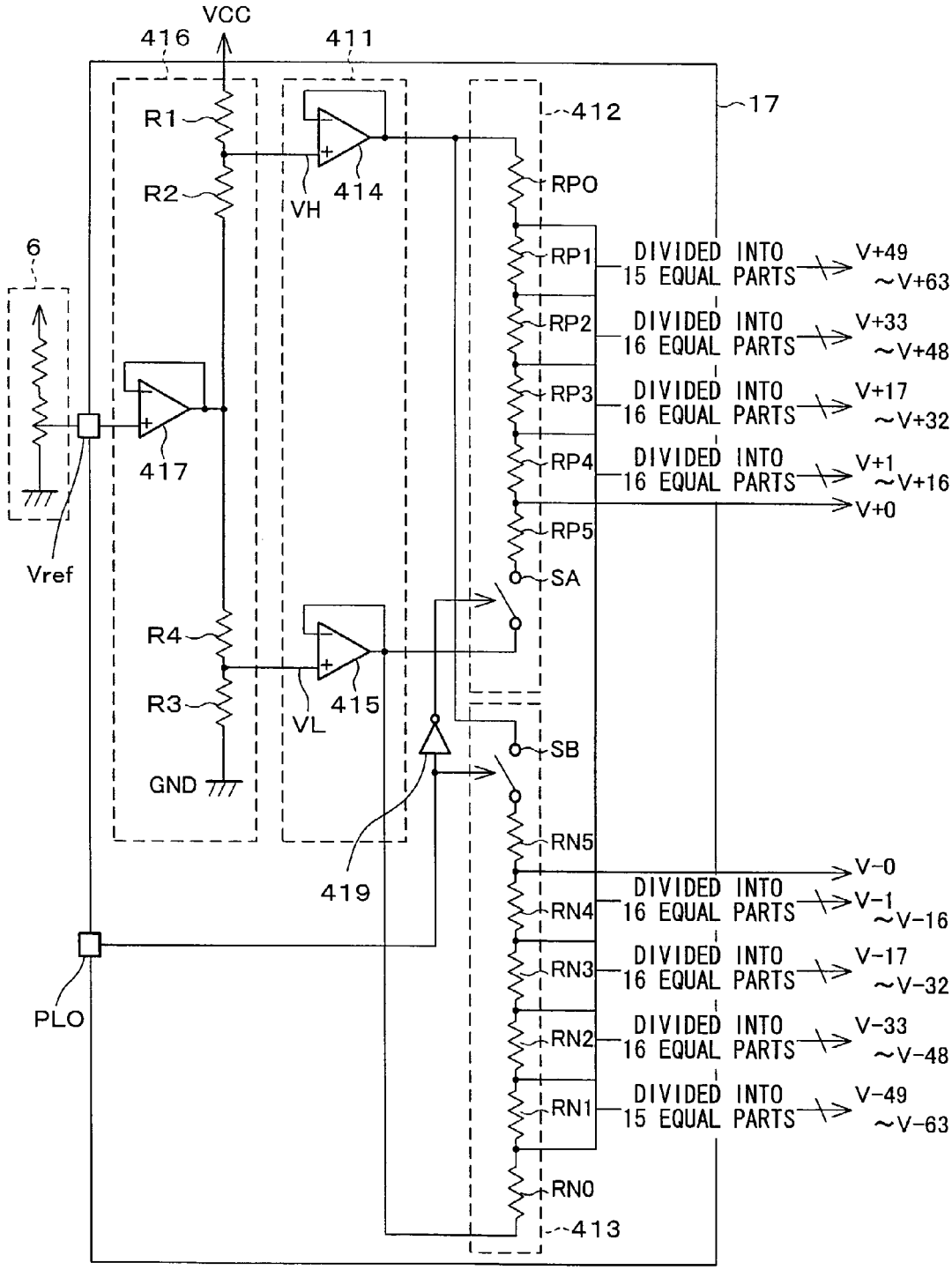
FIG. 1 is a circuit diagram showing a circuit arrangement of a tone voltage generating circuit incorporated in a source driver of an embodiment in accordance with the present invention.

The tone voltage generating circuit 17 contains, as shown in FIG. 1, an adjusting circuit (upper/lower limit voltage generator) 416 capable of adjusting (increasing/decreasing) the range of tone display analog voltages (from a lower limit voltage VL to an upper limit voltage VH) with an invariable width (difference), on the basis of a reference voltage Vref from the electronic volume control 6 externally disposed and connected to a reference voltage input terminal Vref; a buffer circuit (first buffer) 411 composed of voltage follower circuits 414, 415 for adjusting a γ correction value in resistance dividing circuits 412, 413 which will be detailed later; and two resistance dividing circuits (standard voltage generators) 412, 413 to be compatible with AC drive of positive polarity and negative polarity. The resistance dividing circuits 412, 413 each generate multiple tone display analog voltages (standard voltage $V_{+0}$-$V_{+63}$) of positive polarity and multiple tone display analog voltages (standard voltages $V_{-63}$-$V_{-0}$) of negative polarity. The electronic volume control 6 is provided to adjust γ correction values in the resistance dividing circuits 412, 413.

In other words, the tone voltage generating circuit 17 includes resistance dividing circuits 412, 413 which receive an upper limit voltage VH determining a tone display highest voltage (upper limit of the standard voltage: voltage $V_{+63}$ or $V_{-0}$) and a lower limit voltage VL determining a tone display lowest voltage (lower limit of the standard voltage: voltage $V_{+0}$ or $V_{-63}$) and which generate as many standard voltages $V_{+0}$-$V_{+63}$ and $V_{-63}$-$V_{-0}$ having voltage values between the upper limit voltage VH and the lower limit voltage VL as tones by resistance division; and an adjusting circuit 416 which generates the upper limit voltage VH and the lower limit voltage VL. The adjusting circuit 416 is adapted to receive a variable reference voltage (input voltage) Vref adjusted by the external electronic volume control 6 and vary both the upper limit voltage VH and the lower limit voltage VL in accordance with the single reference voltage Vref.

Figure 15:
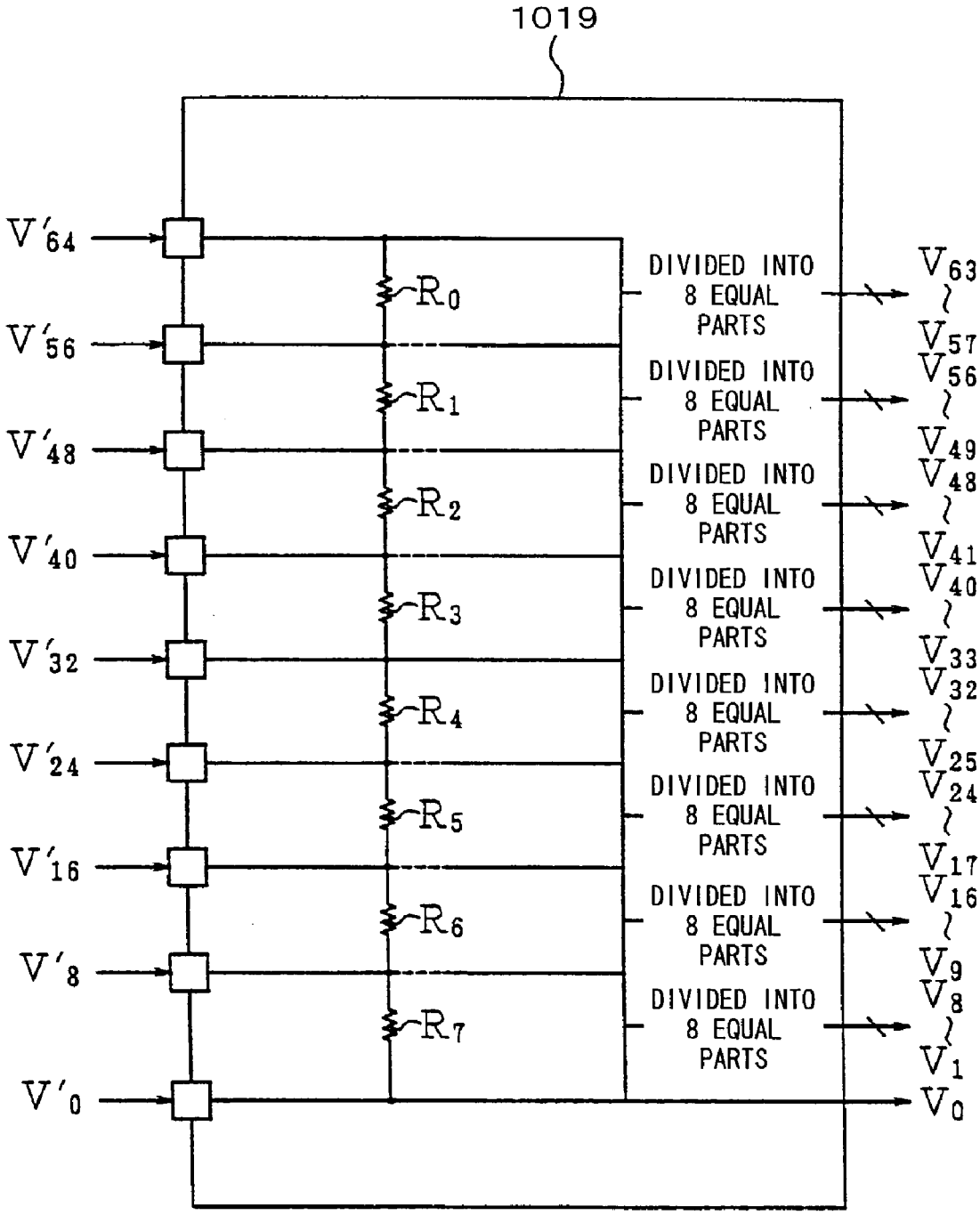
FIG. 15 schematically shows an arrangement of a standard voltage generating circuit in a source driver in related art.
Figure 16:
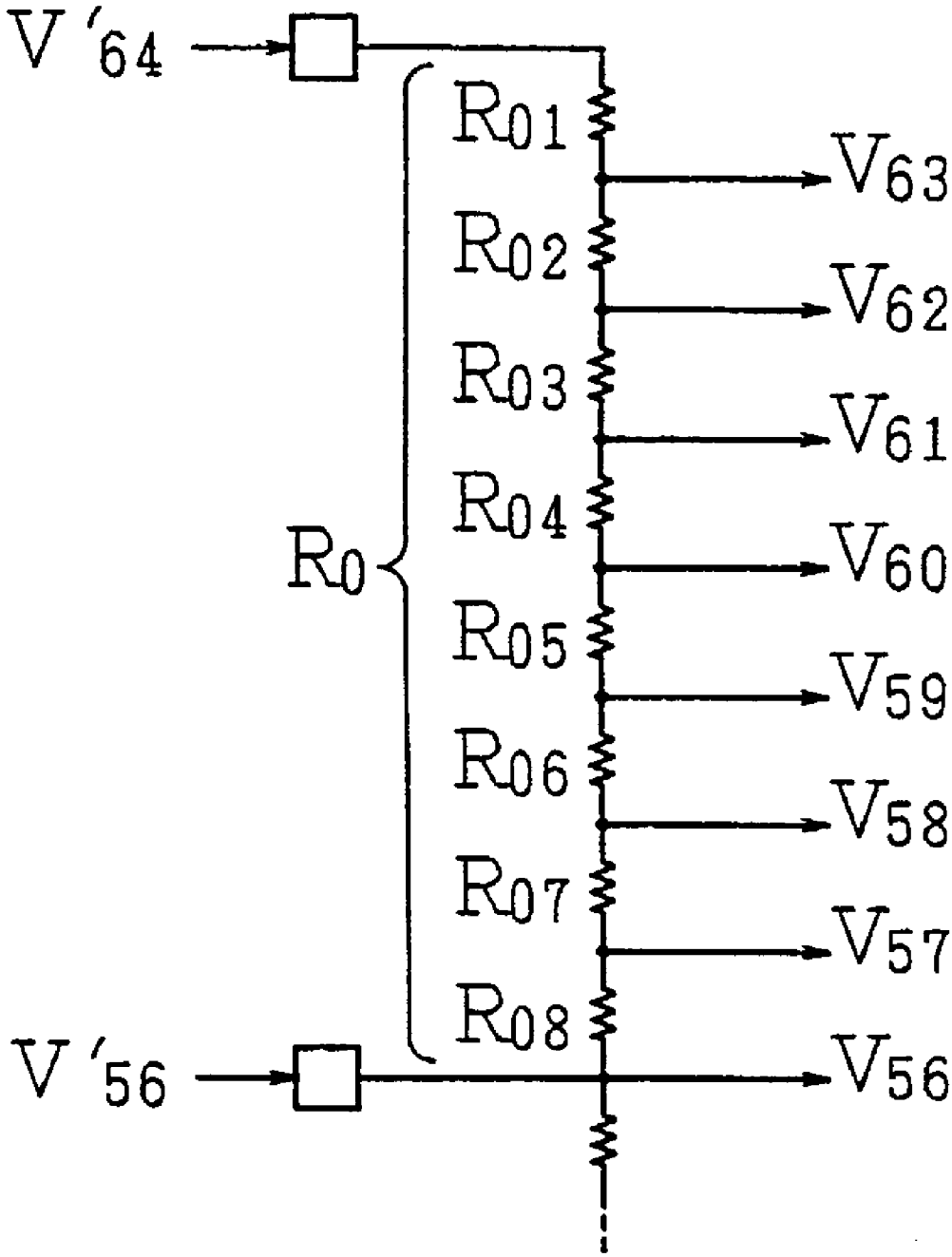
FIG. 16 shows an explanatory drawing in detail of an arrangement of a resistance dividing circuit in the standard voltage generating circuit in FIG. 15.

Similarly to the standard voltage generating circuit 1019 of the related art shown in FIG. 15, the resistance dividing circuits 412, 413 of the present embodiment act to generate 64 standard voltages and generate intermediate voltages between the upper limit voltage VH and the lower limit voltage VL. The resistance dividing circuits 412, 413 are arranged from a resistance dividing circuit (positive standard voltage generator) 412 for positive polarity to be compatible with the reference voltage Vref of positive polarity; and a resistance dividing circuit (negative standard voltage generator) 413 for negative polarity to be compatible with the reference voltage Vref of negative polarity. In other words, the resistance dividing circuits 412, 413 are arranged from a resistance dividing circuit 412 for positive polarity which generates as many standard voltages $V_{+0}$ -$V_{+63}$ of positive polarity as tones corresponding to the reference voltage Vref of positive polarity; and a resistance dividing circuit 413 for negative polarity which generates as many standard voltages $V_{-63}$-$V_{-0}$ of negative polarity as tones corresponding to the reference voltage Vref of negative polarity.

The resistance dividing circuits 412, 413 are provided with a switching unit which activates one of the resistance dividing circuit 412 and the resistance dividing circuit 413 (of which the output is selected) and deactivates the other in accordance with the polarity of a polarity inversion signal REV fed from the controller 4 via a polarity inversion terminal PLO. In other words, the resistance dividing circuits 412, 413 is adapted to select an output (tone display analog voltage) of a different polarity from the polarity inversion signal REV, and only one of the resistance dividing circuits (412 or 413) may operate in accordance with that output and generate a standard voltage of positive polarity or negative polarity.

The switching unit is provided with an analog switch SA which, provided to the positive polarity resistance dividing circuit 412, receives a polarity inversion signal REV; an analog switch SB which is provided to the negative polarity resistance dividing circuit 413; and an inverter 419 which inverts the polarity of the polarity inversion signal PLO and supplies it to the analog switch SA.

The selection of polarity by the resistance dividing circuits 412, 413 is adapted to close either one of the analog switch SA and the analog switch SB in the resistance dividing circuits 412, 413 and open the other in accordance with the level of the polarity inversion signal REV (either HIGH or LOW) from the polarity inversion terminal PLO of the liquid crystal drive output. The analog switches SA, SB are adapted so that only one of the resistance dividing circuits 412, 413 conduct when a HIGH polarity inversion signal REV (application voltage) is applied to the gates of the analog switches SA, SB. In other words, the analog switches SA, SB are adapted so as to conduct only when a positive polarity signal is input.

The resistance dividing circuit 412 is to support the positive polarity reference voltage Vref and arranged from resistors RP0-RP5 having a resistance ratio which is a basis for performing a γ correction and an analog switch SA whose on/off action is controlled through the polarity of the polarity inversion signal REV. Typically, the resistors RP0-RP5 are formed of high-resistance polysilicon.

An end of the resistor RP0, among the resistors RP0-RP5, connects to an output of the voltage follower circuit 414 for upper limit voltage in the buffer circuit 411, whereas the other end of the resistor RP0 connects to an end of the resistor RP1. The resistors RP1-RP4 are each made of multiple resistive elements connected in series. For example, the resistor RP1 is made of 15 resistive elements (not shown) connected in series. The other resistors RP2-RP4 are made of 16 resistive elements connected in series. The remaining end of the resistor RP4 connects to an end of the resistor RP5. The other end of the resistor RP5 connects to an output of the voltage follower circuit 415 for lower limit voltage via the analog switch SA.

Therefore, the resistance dividing circuit 412 is made of a total of 65 resistive elements connected in series.

Similarly to the resistance dividing circuit 412 to support positive polarity, the resistance dividing circuit 413 to support negative polarity is arranged from resistors RN0-RN5 having a resistance ratio which is a basis for performing a γ correction and an analog switch SB whose on/off action is controlled through the polarity of the polarity inversion signal REV. Typically, the resistors RN0-RN5 are formed of high-resistance polysilicon.

An end of the resistor RN0, among the resistors RN0-RN5, connects to an output of the voltage follower circuit 415 for lower limit voltage, whereas the other end of the resistor RN0 connects to an end of the resistor RN1. The resistor RN1 through RN4 are each made of multiple resistive elements connected in series. For example, the resistor RN1 is made of 15 resistive elements (not shown) connected in series. The other resistors RN2-RN4 are made of 16 resistive elements connected in series. The remaining end of the resistor RN4 connects to an end of the resistor RN5. The other end of the resistor RN5 connects to an output of the voltage follower circuit 414 for upper limit voltage through the analog switch SB.

Therefore, the resistance dividing circuit 413 is also made of a total of 65 resistive elements connected in series.

Now, the arrangement of the adjusting circuit 416 will be described in detail in reference to FIG. 7.

The adjusting circuit 416 is made of a resistance dividing circuit (resistance divider) composed of 4 resistive elements connected in series between a liquid crystal drive power source 5 and ground potential GND (fixed voltage). More specifically, the adjusting circuit 416 is arrangement from a resistive element (first resistor) R1 between the supply point (node) A for the power source voltage Vcc and the upper limit voltage VH; a resistive element (second resistor) R2 between the output point for the upper limit voltage VH and the supply point (node) B for the reference voltage Vref; a resistive element (fourth resistor) R3 between the supply point (node) C for the ground potential GND and the output point for the lower limit voltage VL; and a resistive element (third resistor) R4 between the supply point B for the reference voltage Vref and the lower limit voltage VL.

The resistive elements R1-R4 are specified to have resistance values so that they satisfy $$R1:R2=R3:R4$$

where R1 is the resistance value of the resistive element R1, R2 is the resistance value of the resistive element R2, R3 is the resistance value of the resistive element R3, and R4 is the resistance value of the resistive element R4.

The reference voltage input terminal Vref is fed externally with a reference voltage Vref set to a voltage value between the power source voltage VCC and the ground potential GND (=0 V).

The resistance ratio of the resistive elements R1-R4 being specified to meet R1:R2=R3:R4, the upper limit voltage VH generated at the node A and the lower limit voltage VL generated at the node C are given by:

$$VH = Vref + (VCC - Vref) \times R2/(R1 + R2)$$
$$= Vref \times R1/(R1 + R2) + VCC \times R2/R1 + R2)$$
$$VL = GND + (Vref - GND) \times R3/(R3 + R4)$$
$$= GND \times R4/(R3 + R4) + Vref \times R3/(R3 + R4)$$
$$= GND \times R2/(R1 + R2) + Vref \times R1/(R1 + R2)$$

Therefore, the difference (voltage range) between the upper limit voltage VH and the lower limit voltage VL is given by:

$$VH-VL=(VCC-GND)\times R2/(R1+R2)$$

whereby the difference is invariable regardless of the value of the voltage Vref.

Thus, only by changing the voltage value setting of the reference voltage Vref, the voltage values of the upper limit voltage VH and the lower limit voltage VL determining the range of the tone display standard voltage can be variably controlled while maintain the difference between the voltage values constant.

Next, this particular point will be described by way of specific examples. For example, in FIG. 7, assuming that the resistive elements R1-R4 have resistance ratios of R1:R2=1:9 and R3:R4=1:9, VCC=5 V, GND=0 V, and Vref=2.5 V, the upper limit voltage VH, the lower limit voltage VL, and the difference between the upper limit voltage VH and the lower limit voltage VL are determined as follows. The voltage value of the upper limit voltage VH is given by:

$$VH = Vref + (VCC - Vref) \times R2/(R1 + R2)$$
$$= 2.5\ \text{V} + 2.25\ \text{V}$$
$$= 4.75\ \text{V}$$

The voltage value of the lower limit voltage VL is given by:

$$VL = GND + (Vref - GND) \times R3/(R3 + R4)$$
$$= 0\ \text{V} + 0.25\ \text{V}$$
$$= 0.25\ \text{V}$$

The difference between the upper limit voltage VH and the lower limit voltage VL is given by:

$$VH-VL=4.75\ V-0.25\ V=4.5\ V$$

Further, varying only the reference voltage Vref to 3.0 V, and leaving the other voltage conditions unchanged (i.e., VCC=5 V, GND=0 V), the upper limit voltage VH, the lower limit voltage VL, and the difference between the upper limit voltage VH and the lower limit voltage VL are determined as follows. The voltage value of the upper limit voltage VH is given by:

$$VH = Vref + (VCC - Vref) \times R2/(R1 + R2)$$
$$= 3.0\ \text{V} + 1.80\ \text{V}$$
$$= 4.80\ \text{V}$$

The voltage value of the lower limit voltage VL is given by:

$$VL = GND + (Vref - GND) \times R3/(R3 + R4)$$
$$= 0\ \text{V} + 0.30\ \text{V}$$
$$= 0.30\ \text{V}$$

The difference between the upper limit voltage VH and the lower limit voltage VL is given by:

$$VH-VL=4.80\ V-0.30\ V=4.5\ V$$

In this manner, 64 tone display standard voltages $V_{+0}$-$V_{+63}$ or $V_{-63}$-$V_{-0}$ (range from the lower limit voltage VL to the upper limit voltage VH) can be readily adjusted (increased/decreased) in accordance with the reference voltage Vref from the electronic volume control 6 externally disposed as a voltage regulator and connected to a reference voltage input terminal Vref within an invariable width (voltage difference VH−VL).

Figure 7:
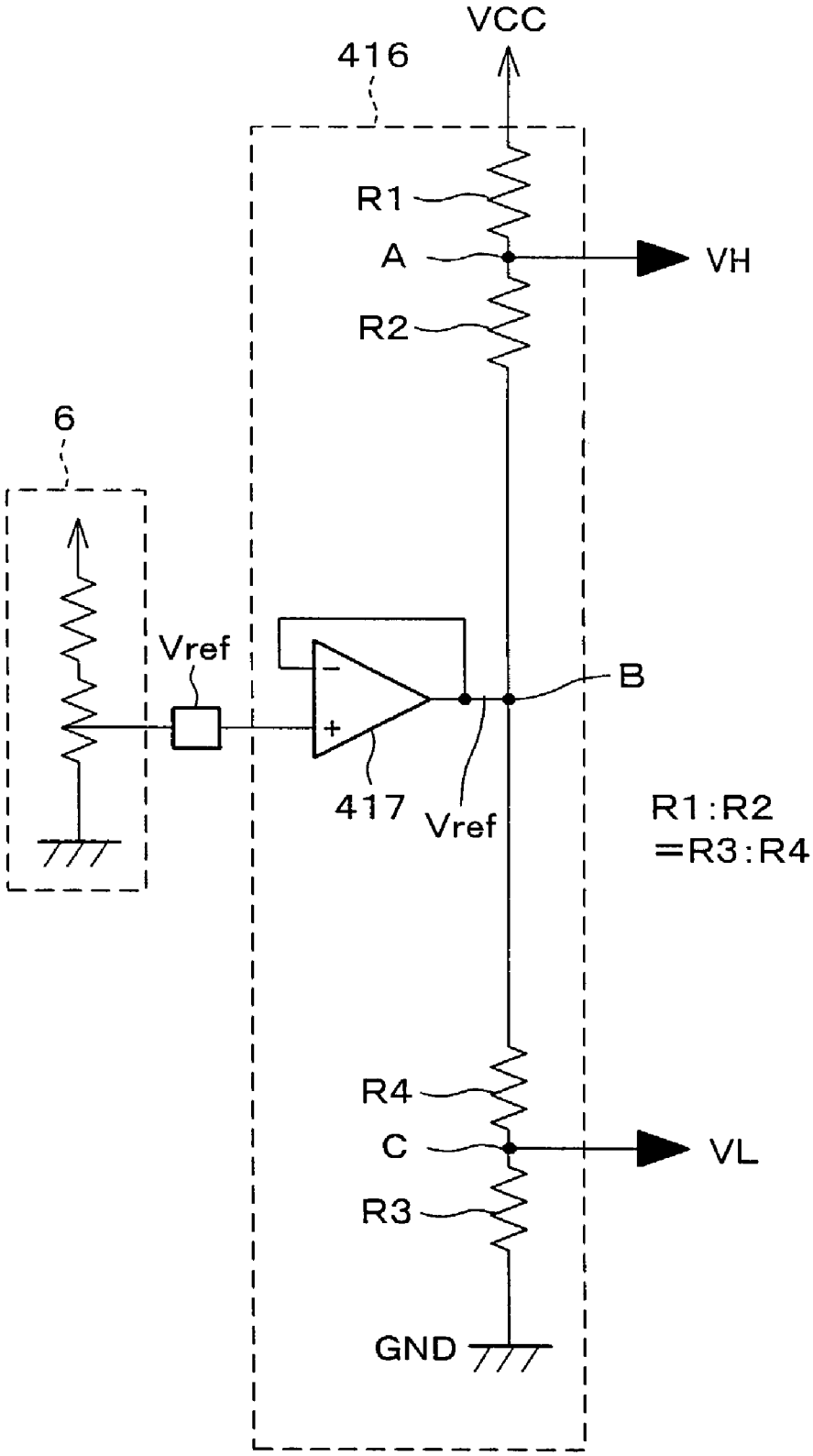
FIG. 7 is a circuit diagram showing an arrangement of a part including an adjusting circuit in the tone voltage generating circuit in FIG. 1.

As shown in FIG. 1, a voltage follower circuit 417 is inserted between the node B (as shown in FIG. 7) of the adjusting circuit 416 and the reference voltage input terminal Vref. The voltage follower circuit 417 is to reduce electric power consumption due to a through current flow through the resistive elements R1-R4. The inserted voltage follower circuit 417 adds to the resistance values of the resistive elements R1-R4, restricting the value of the electric current flow through the resistive elements R1-R4. As a result, power consumption can be reduced. The inserted voltage follower circuit 417 makes it possible to supply low-impedance voltage (reference voltage Vref) to the resistive elements R1-R4. Hence, it is ensured, with the resistive elements R1-R4, that the difference between the upper limit voltage VH and the lower limit voltage VL is constant. The voltage follower circuit 417 in the adjusting circuit 416 may be omitted without causing any operational problems.

The selector circuit 20 is to select either one of the sets, i.e., a set of multiple tone display analog voltages (standard voltages $V_{+0}$-$V_{+63}$) output from the resistance dividing circuit 412 and a set of multiple tone display analog voltages (standard voltages $V_{-63}$-$V_{-0}$) output from the resistance dividing circuit 413, in accordance with the polarity of the polarity inversion signal REV supplied from the polarity inversion terminal PLO of the liquid crystal drive output, and feed the selected set to the DA converter circuit 18.

The standard voltage is output from liquid crystal drive voltage output terminals 40 (hereinafter, simply, "output terminals") to the source signal lines 34 of the liquid crystal panel 1 via the output circuit 38. The output circuit 38 is arranged from a voltage follower circuit using a differential amplifier circuit which will be detailed later.

The selector circuit 20 is arranged from an analog switch (not shown) controlled through the polarity inversion signal REV. The selector circuit 20 selects either the application voltages $V_{+0}$ through $V_{+63}$ for positive polarity from the resistance dividing circuit 412 or the application voltages $V_{-0}$ through $V_{-63}$ for negative polarity from the resistance dividing circuit 413 in accordance with HIGH or LOW of the polarity inversion signal REV supplied from the polarity inversion terminal PLO for each output from the liquid crystal drive voltage output terminals, and outputs the selected voltages to the DA converter circuit 18. The analog switch is adapted to conduct when a HIGH application voltage is applied to the gate of the analog switch.

Table 1 below shows the relationship between the polarity inversion signal REV and the application voltages selected by the selector circuit 20.

TABLE 1

| Polarity Inversion Signal REV | Selector Circuit |
|---|---|
| LOW | Positive $V_{+0}$–$V_{+63}$ |
| HIGH | Negative $V_{-0}$–$V_{-63}$ |

The DA converter circuit 18 selects one analog voltage in accordance with the display data level-shifted by the level shifter circuit 16 from various tone display voltages (analog voltages) supplied from the tone voltage generating circuit 17.

This analog voltage representing a tone display is output from the liquid crystal drive voltage output terminals 22 (hereinafter, simply, "output terminals") to the source signal lines of the liquid crystal panel through the output circuit 19. The output circuit 19 is arranged from a voltage follower circuit using a differential amplifier circuit.

Figure 17:
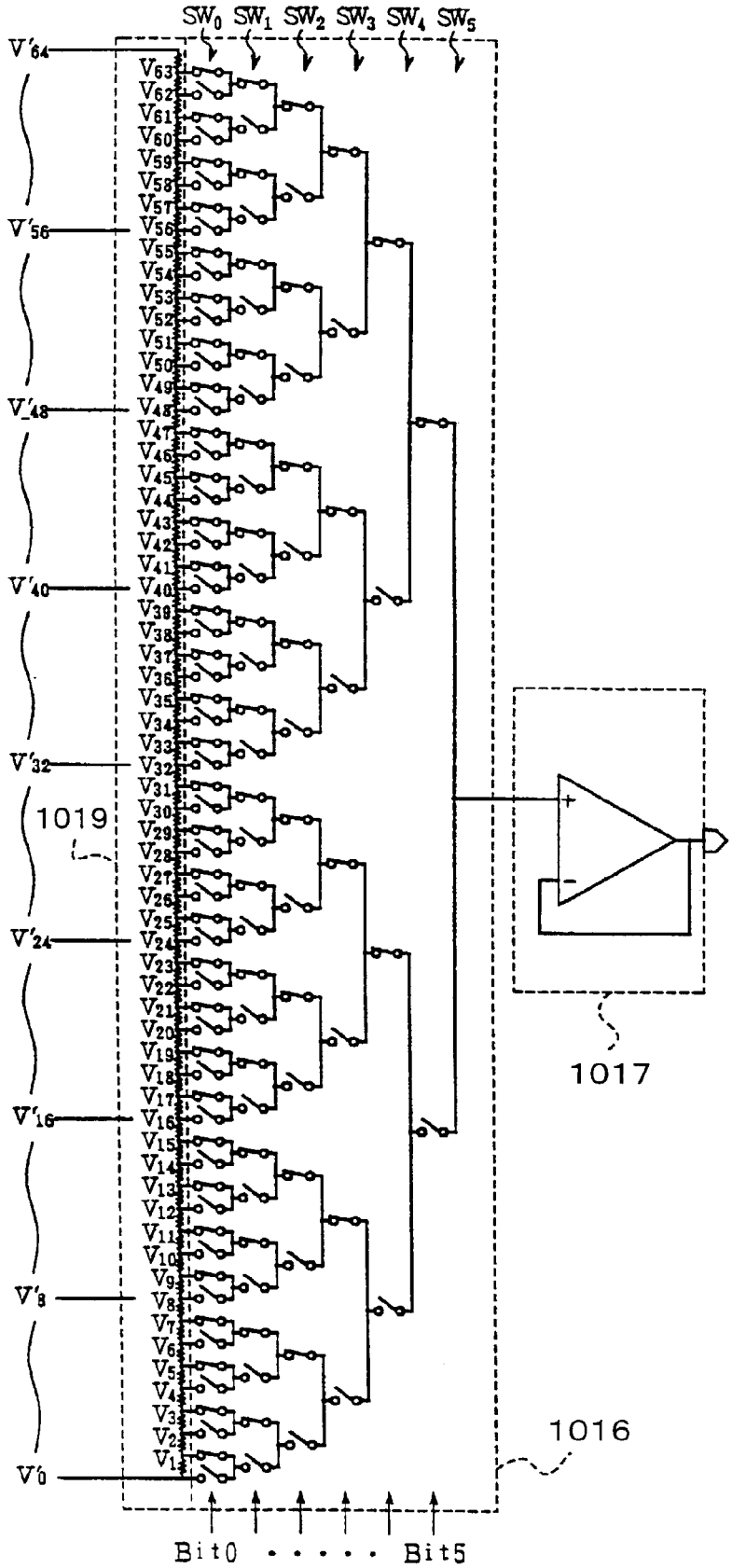
FIG. 17 shows a schematic arrangement of a DA converter circuit and an output circuit in a source driver in related art.
Figure 18:
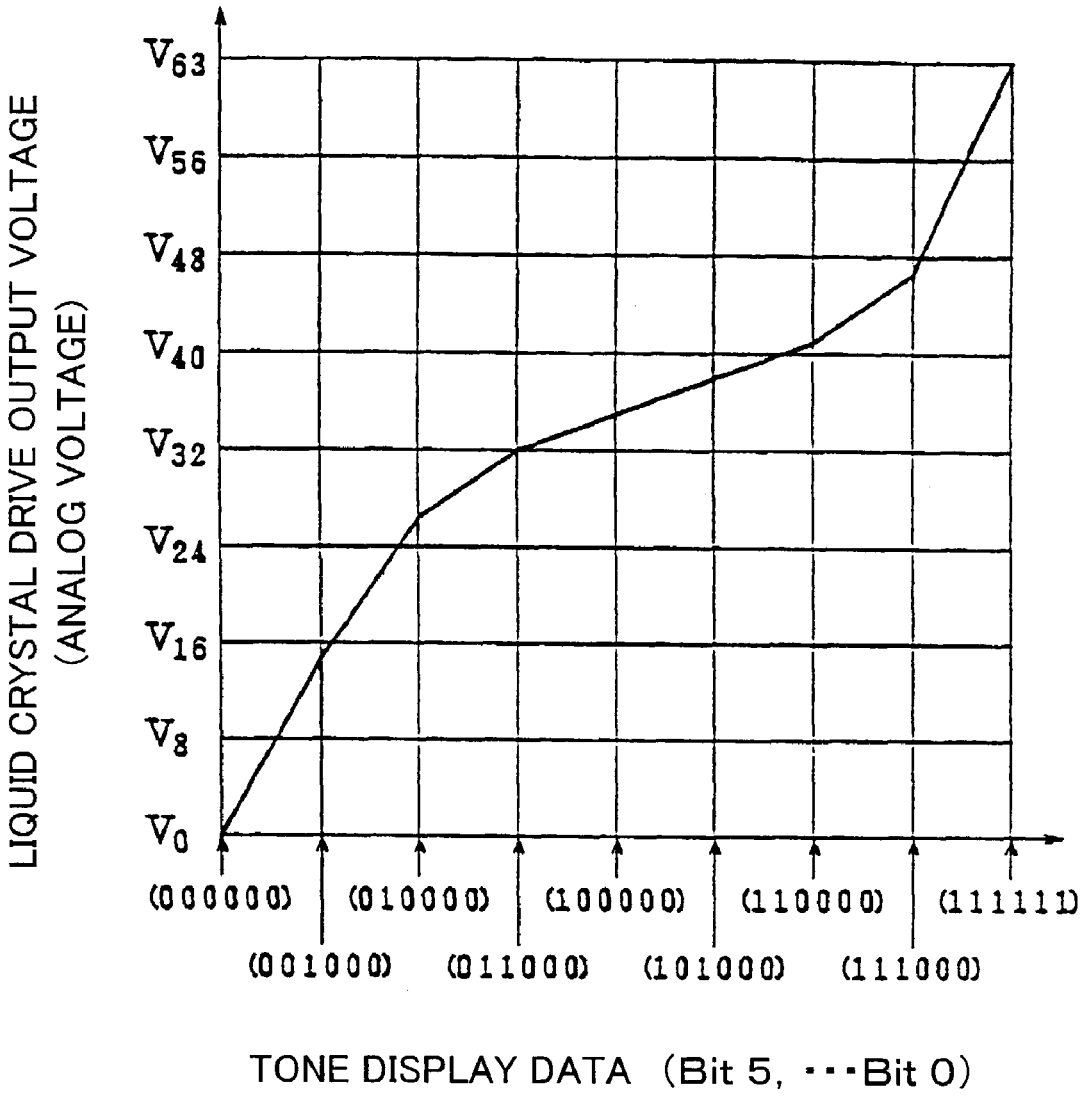
FIG. 18 shows a relationship between tone display data and a liquid crystal drive output voltage after γ correction.
Figure 19:
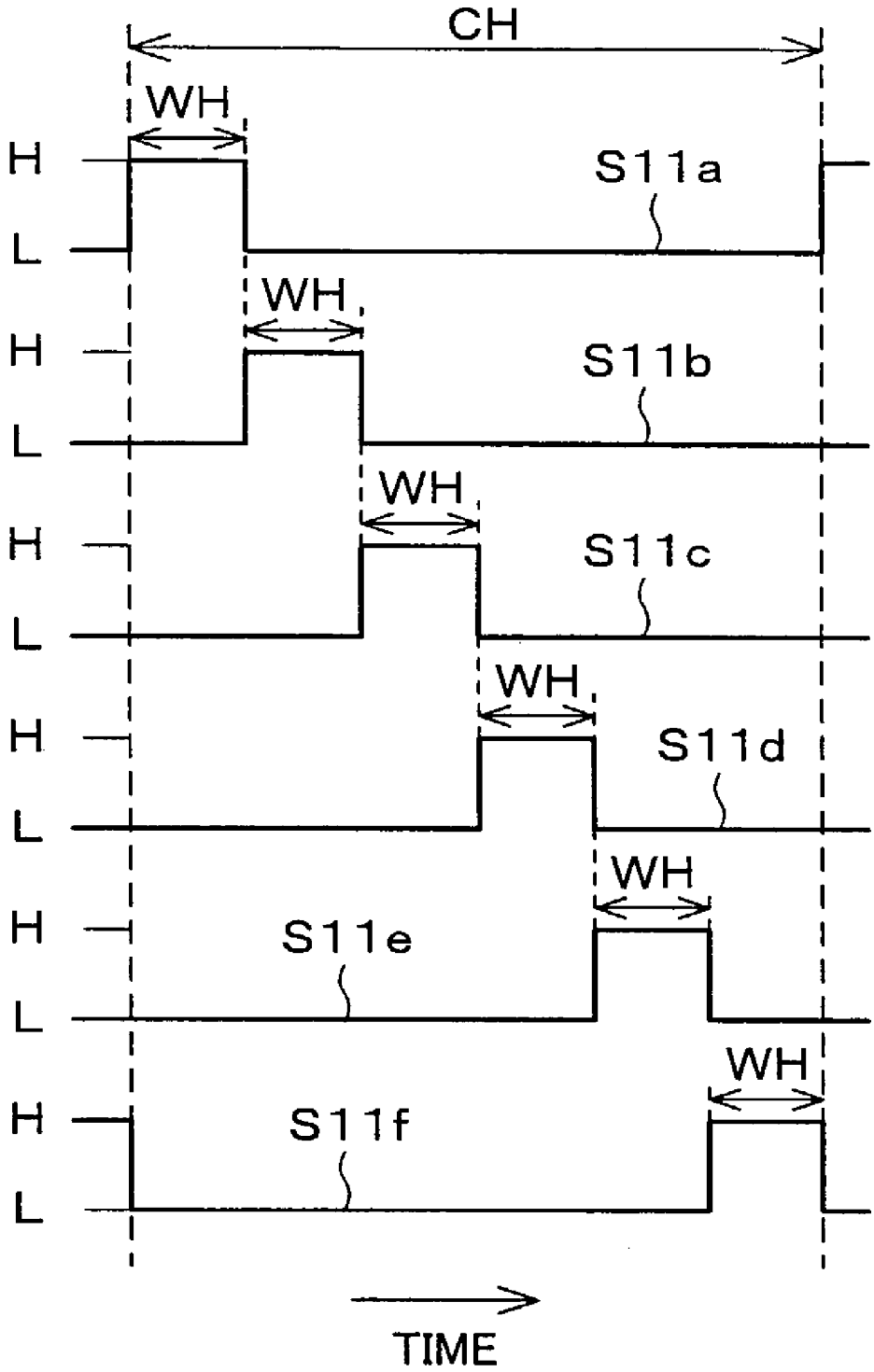
FIG. 19 is a timing chart showing a scan signal.
Figure 20:
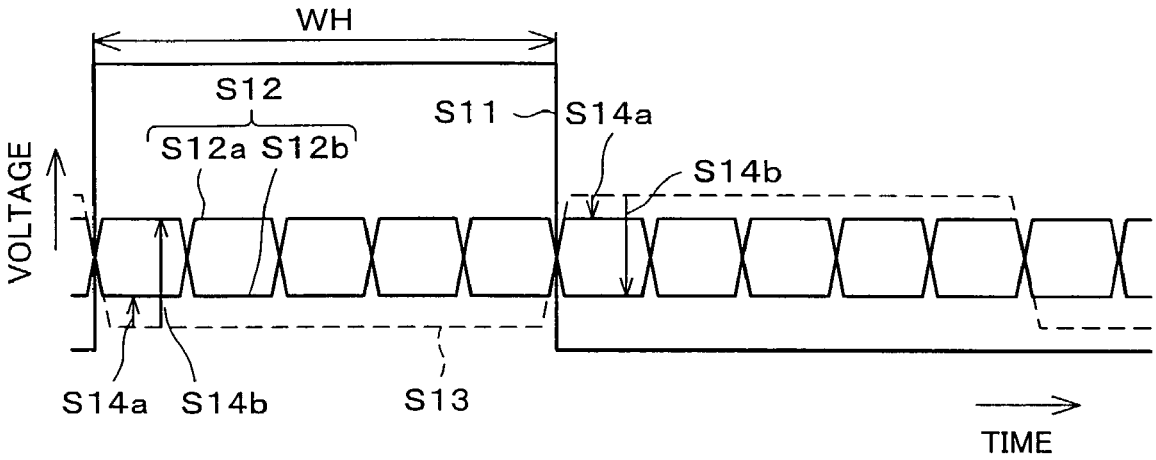
FIG. 20 is a timing chart showing a scan signal, a data signal, and a voltage applied to an opposite electrode.

As the DA converter circuit 18 and output circuit 19, the DA converter circuit 1016 and the output circuit 1017 shown in FIG. 17 are suitably used similarly to the arrangement of the aforementioned related art. The DA converter circuit 1016 and the output circuit 1017 are the same as those mentioned in the foregoing: description thereof is therefore omitted here.

Figure 8:
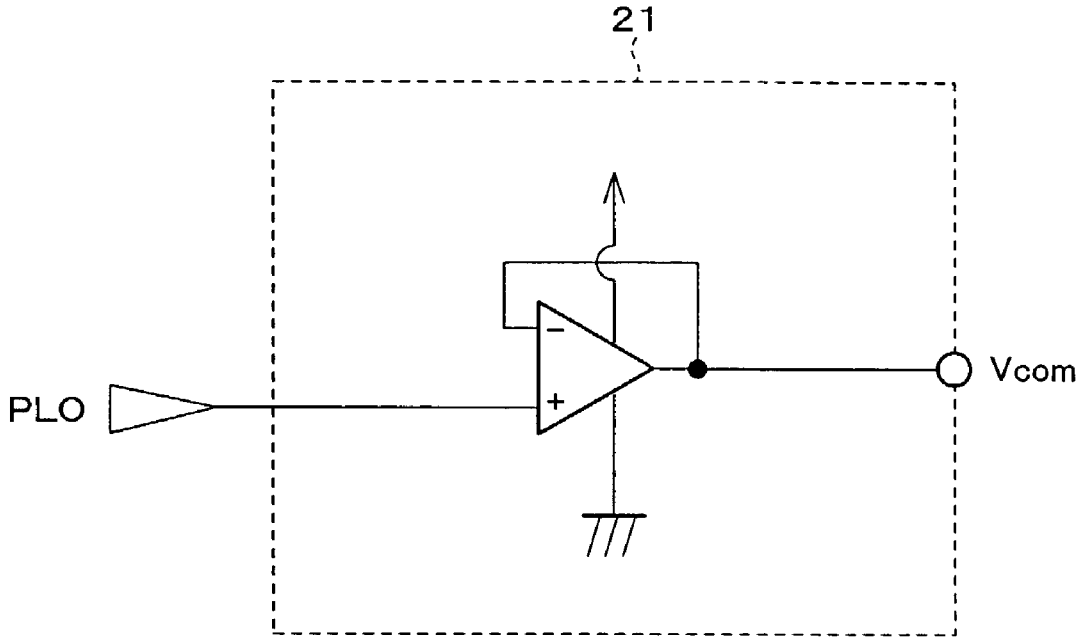
FIG. 8 is a circuit diagram showing a circuit arrangement of an opposite electrode drive circuit in the source driver in FIG. 6.

The opposite electrode drive circuit 21, as shown in FIG. 8, includes a built-in voltage follower circuit (second buffer) 21*b* using a differential amplifier circuit 21*a* as a second buffer to buffer a power source voltage. The opposite electrode drive circuit 21 low-impedance converts the polarity inversion signal REV supplied from the polarity inversion terminal PLO in the voltage follower circuit 21*b* and thereafter outputs the signal REV as the opposite electrode drive voltage Vcom to the opposite electrode 7 of the liquid crystal panel 1.

The description has presented an example including as the opposite electrode drive circuit 21 the voltage follower circuit 21*b* with an operational amplifier (operational amplifier device), but is not limited to that arrangement. For example, as an opposite electrode drive circuit 21 of another arrangement, a polarity inversion signal REV is temporarily level-shifted to a liquid crystal drive voltage by a level shifter circuit (for example, an identical circuit to the level shifter circuit 16 in the source drivers 2), and thereafter, output through an output buffer circuit (voltage follower circuit), to obtain the same effects. Further, the input signal (voltage level) may be amplified by using a differential amplifier circuit as an inverting amplifier circuit or non-inverting amplifier circuit, instead of using the voltage follower circuit 21*b* to perform low-impedance conversion while keeping the voltage level.

As in the foregoing, in the tone voltage generating circuit 17 of the present embodiment, the range of the 64 tone display standard voltages $V_{+0}$-$V_{+63}$ or $V_{-63}$-$V_{-0}$ (the amplitude voltage values of the tone display analog voltages) can be readily adjusted (increased/decreased) within a constant voltage width by means of the upper limit voltage VH and the lower limit voltage on the basis of the reference voltage Vref from the external electronic volume control 6 connected to the input terminal Vref.

Further, since 64 tone display standard voltages $V_{+0}$-$V_{+63}$ or $V_{-63}$-$V_{-0}$ can be readily adjusted, the γ correction characteristics (γ characteristics) can be readily changed in a γ correction value voltage range in accordance with the properties of the liquid crystal panel 1 and the type of the liquid crystal material. More specifically, first, as mentioned earlier, the zigzag line properties of the liquid crystal drive output voltage when γ correction is preformed differ depending on the type of the liquid crystal material and the pixel count of the liquid crystal panel; however, the voltage ratios between the tones of the characteristic curves are equal for equal tone values. Therefore, theoretically, a desired γ correction can be performed by adjusting the voltage value of the upper limit voltage VH and the lower limit voltage VL in the tone voltage generating circuit 17. Then, since the upper limit voltage VH and the lower limit voltage VL is adjusted by the tone voltage generating circuit 17 to a DC voltage of any given voltage value in accordance with the externally supplied reference voltage Vref, the bias values (tone display analog voltage values) in the resistance dividing circuits 412, 413 are adjusted in accordance with the reference voltage Vref. Therefore, in the arrangement of the present embodiment, the γ correction characteristics (γ characteristics) can be readily changed by adjusting only the reference voltage Vref.

Therefore, according to the arrangement of the present embodiment, the γ characteristics (γ correction amount) can be readily adjusted to match with characteristics of the liquid crystal material and the liquid crystal panel 1 without remaking the source drivers 2. Since the difference between the upper limit voltage VH and the lower limit voltage VL is kept constant, the contrast of the image displayed on the display panel 1 can be kept substantially constant. Consequently, the γ characteristics can be readily adjusted in accordance with the characteristics of the display panel 1 while avoiding flickering on the screen from being easily perceived due to too high or low a contrast.

"Contrast" refers to the amplitude of a difference in brightness in a single image which is given by (Lon-Loff)/Loff where Lon is the highest brightness and Loff is the lowest brightness.

In other words, in the tone voltage generating circuit 17 of the present embodiment, the combination of the resistance dividing circuits 412, 413 and the adjusting circuit 416 generates therein 64 tone display standard voltages $V_{+0}$-$V_{+63}$ or $V_{-63}$-$V_{-0}$ from the single reference voltage Vref. Therefore, there is no need to provide 9 halftone voltage input terminals $V_0$ through $V_{64}$ as in the tone display standard voltage generating circuit 1019 of the related art shown in FIG. 15. A single reference voltage input terminal Vref to input an external reference voltage Vref (and a terminal to input a power source voltage VCC) is only required. Therefore, the terminal count and circuit size of the tone voltage generating circuit 17 can be reduced, allowing for further reduction of the tone voltage generating circuit 17 in size and cost. The simpler arrangement of the tone voltage generating circuit 17 allows for simpler source drivers 2 which will be easily integrated into a single chip.

Further, in a liquid crystal display of the present embodiment incorporating the tone voltage generating circuit 17, the halftone standard voltages (standard voltages $V_{+0}$-$V_{+63}$ or $V_{-63}$-$V_{-0}$) are internally generated; therefore, there is no need to externally supply halftone standard voltages to the tone voltage generating circuit 17. This allows for simplification in arrangement, as well as reduction in size and cost, of the voltage supply section in the liquid crystal display. The 64 tone display standard voltages $V_{+0}$-$V_{+63}$ or $V_{-63}$-$V_{-0}$ can be readily adjusted by adjusting a single reference voltage Vref using the electronic volume control 6. This allows for simplification, as well as reduction in size and cost, of the arrangement adjusting the reference voltage Vref.

The source drive circuit 2A as a display driving device in accordance with the present embodiment is arranged from a single chip (source drivers 2) on which a source line drive circuit and an opposite electrode drive circuit 21 are integrated. This is an attempt for further reduction in size. As a result, even smaller liquid crystal drive circuits and liquid crystal drive devices can be provided.

In a liquid crystal display as a display in accordance with the present embodiment, the reference voltage Vref is supplied to the standard voltage input terminal Vref, and the electronic volume control 6 adjusting the standard voltage Vref is disposed external to the tone voltage generating circuit 17. This allows for easy adjustment of the γ correction value without newly remaking the liquid crystal drive power source 5 in the tone voltage generating circuit 17.

In the present embodiment, the buffer circuit 411 buffering the upper limit voltage VH and the lower limit voltage VL is provided between the resistance dividing circuits 412, 413 and the adjusting circuit 416. Since the liquid crystal display loads (pixels) are capacitive, the stability of the levels of the tone display analog voltages (standard voltages $V_{+0}$-$V_{+63}$ or $V_{-63}$-$V_{-0}$) is especially important. In the present embodiment, the upper limit voltage VH and the lower limit voltage VL are input through the buffer circuit 411 to the resistance of the lines in the resistance dividing circuits 412, 413 where the maximum voltage VH and the minimum voltage VL are input; therefore, the input voltage can be low-impedance converted to eliminate variations in voltage when the capacitive load charges/discharges. The tone display analog voltage can be stabilized. Further, the values of the electric current flows through the resistance dividing circuits 412, 413 can be restricted, which reduces power consumption. The addition of the buffer circuit 411 in its nature does not increase power consumption significantly.

Figure 9:
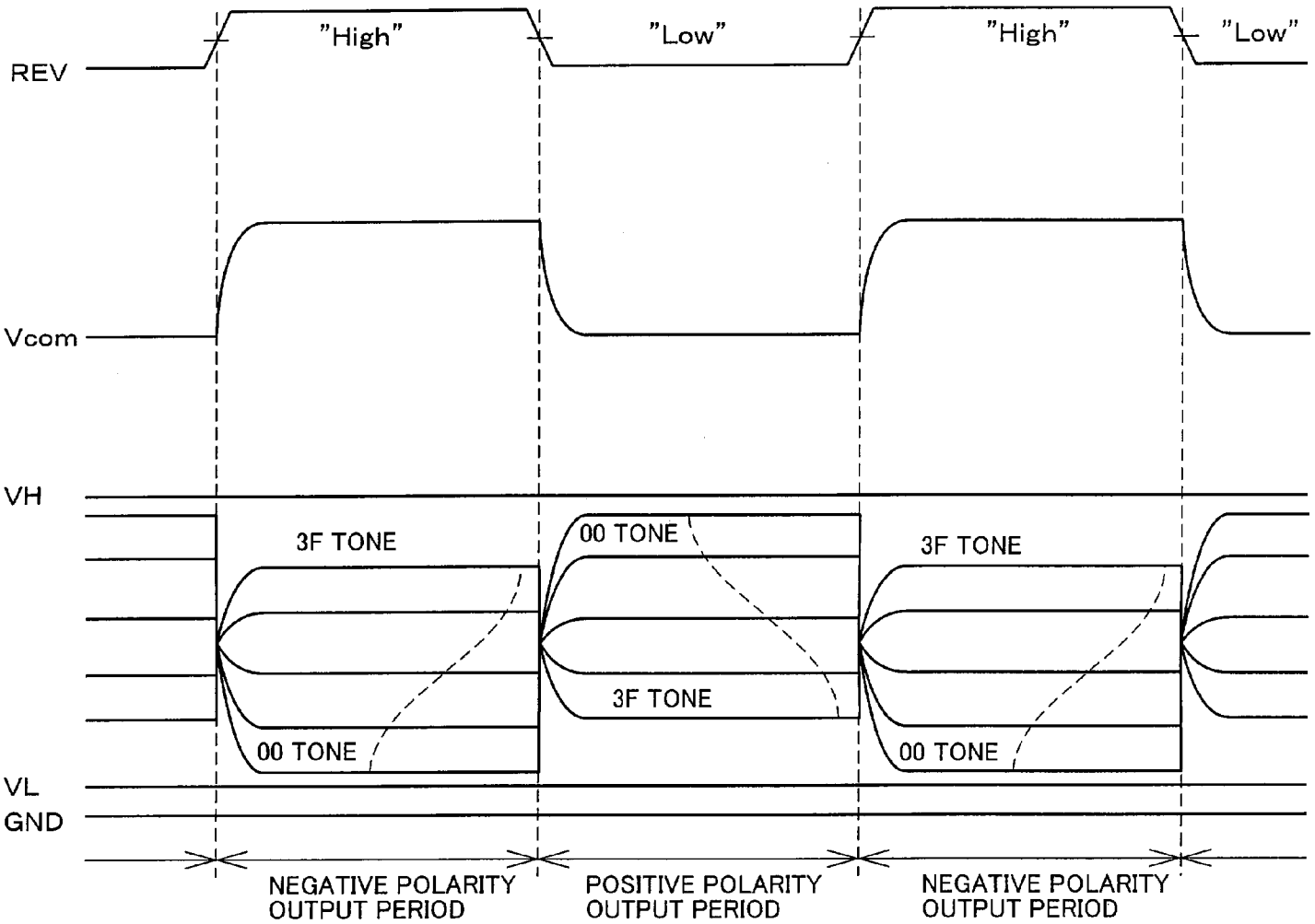
FIG. 9 is a drawing showing a relationship among a polarity inverting signal, an opposite electrode drive voltage, and a tone display analog voltage having positive and negative polarities from a source driver output terminal.

FIG. 9 shows the relationship among the polarity inversion signal REV, the opposite electrode drive voltage Vcom, and the tone display analog voltage of positive polarity and negative polarity from the source driver output terminals.

During a negative polarity output period, as shown by 5 solid and broken lines in FIG. 9, the tone display voltages from the 00 tone display voltage in hexadecimal notation or 0 tone display voltage in decimal notation (tone display lowest voltage) close to the voltage VL to the 3F tone display voltage in hexadecimal notation or 63 tone display voltage in decimal notation (tone display highest voltage) are output as tone display analog voltages. Meanwhile, during a positive polarity output period, as shown by 5 solid and broken lines in FIG. 9, the tone display voltages from the 3F tone display voltage close to the voltage VL to the 00 tone display voltage close to the voltage VH are output. The differences between the tone display voltages and the opposite electrode drive voltage Vcom are applied to the liquid crystal as effective voltages to effect a tone display.

The arrangement of the present embodiment divides a resistance dividing circuit (412, 413) into two resistance dividing circuits 412, 413 and provides the analog switches SA, SB to switch between them. Alternatively, the resistance dividing circuit may not be divided into two parts, and the analog switches SA, SB may be omitted. Note however that as mentioned in the foregoing, to reduce the through current flow through the resistance dividing circuits 412, 413, it is preferable to divide a resistance dividing circuit (412, 413) into two resistance dividing circuits 412, 413 and provide the analog switches SA, SB which switch between them. The omission of the buffer circuit (the first buffer) 411 increases power consumption; however, the effect is obtained that the γ correction value can be readily adjusted.

In the arrangement of the present embodiment, the resistive elements R1-R4 are fed at the both ends thereof with the power source voltage VCC and the ground potential GND (=0 V). The electric potentials of the both ends (electric potential point) of the resistive elements R1-R4 are not limited in any specific manner, provided that they are kept at different potentials. Therefore, for example, an end of the resistive element R3 may be connected to a power source supplying a negative power source voltage, instead of ground potential GND.

Embodiment 2

The following will describe another embodiment in accordance with FIG. 10 through FIG. 12 and FIG. 22.

The invention of the present embodiment has an objective to further reduce power consumption by the tone voltage generating circuit 17 and the opposite electrode drive circuit 21 of embodiment 1.

Figure 10:
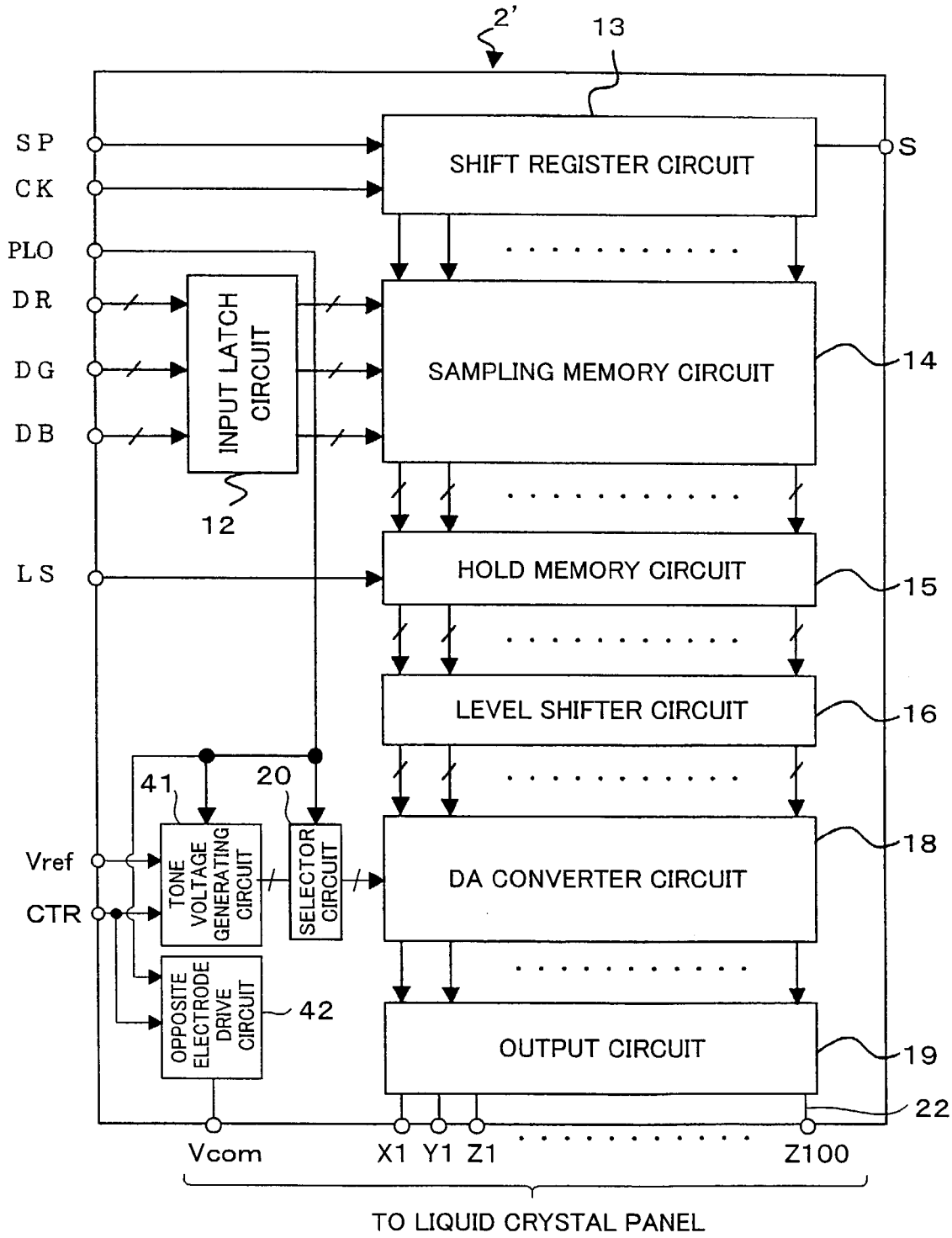
FIG. 10 is a block diagram schematically showing an arrangement of a source driver of another embodiment in accordance with the present invention.

Source drivers 2 as a display driving device in accordance with the present embodiment, as shown in FIG. 10, has the same arrangement as the source drivers 2 of embodiment 1, except that a control terminal CTR where a control signal CTR is applied in the form of HIGH and LOW level voltages is additionally provided to the source drivers 2 of embodiment 1, that the tone voltage generating circuit 17 now is changed to control actions of various parts in accordance with the control signal CTR and designated a tone voltage generating circuit 41, and that the opposite electrode drive circuit 21 now is changed to control actions of various parts in accordance with the control signal CTR and designated an opposite electrode drive circuit 42.

The voltage follower circuits 414, 415 of the buffer circuit 411, the voltage follower circuit 417 of the adjusting circuit 416, and the voltage follower circuit 41*b* (an equivalent of the voltage follower circuit 21*b*) of the opposite electrode drive circuit 41 in the tone voltage generating circuit 41 are adapted to start/stop operation in accordance with whether the control signal CTR applied to the control terminal CTR is HIGH or LOW.

The following will describe an example of an operational amplifier which is usable as the voltage follower circuits 414, 415, 417, 21*b*.

The operational amplifier acts as a differential amplifier circuit under normal drive when the control signal CTR is HIGH, and is deactivated with its output in a high impedance state when the control signal CTR is LOW.

Figure 22:
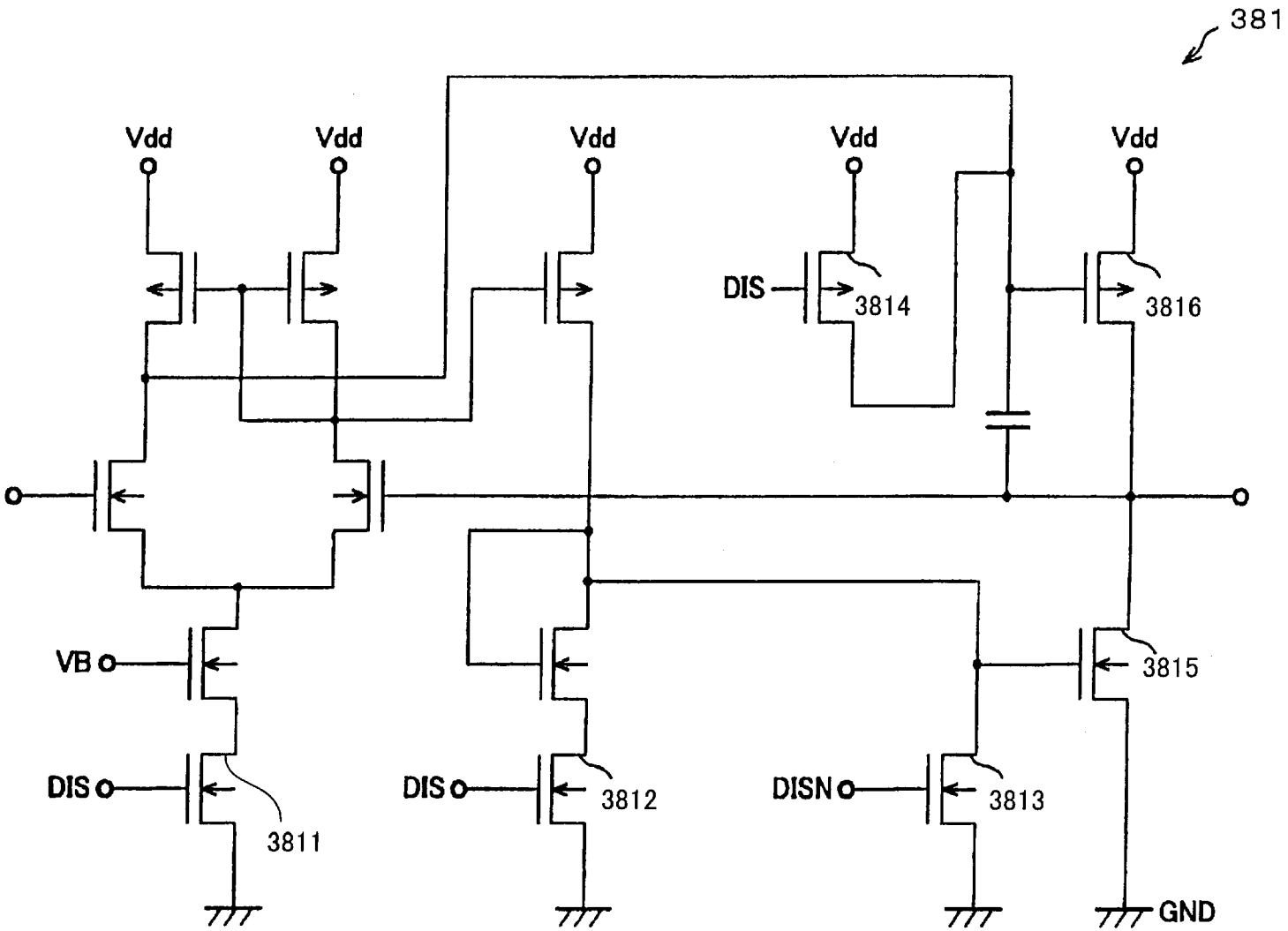
FIG. 22 is a circuit diagram showing an example of an operational amplifier usable in another embodiment in accordance with the present invention.

As shown in FIG. 22, in an operational amplifier 381, the DIS terminals receive a control signal CTR, and the DISN terminals (not shown) receive a control signal CTR inverted by an inverter circuit. In FIG. 22, VB refers to a voltage input terminal to specify the value of a constant current flow through a differential pair determining an operational point.

In the operational amplifier 381, when the control signal CTR is HIGH (Vdd level), Nch MOS transistors 3811, 3812 are in the "on" state and fed with operational electric current, and Nch MOS transistor 3813 and Pch MOS transistor 3814 is in the "off" state. The operational amplifier 381 therefore operates as an ordinary differential amplifier circuit.

In contrast, when the control signal CTR is LOW (GND level), the Nch MOS transistor 3811, 3812 are in the "off" state and no longer fed with an operational electric current, and the Nch MOS transistor 3813 and Pch MOS transistor 3814 are in the "on" state. Thus, the Nch MOS transistor 3815 and the Pch MOS transistor 3816 in the output stage are turned into the "off" state, in other words, the output is turned into the high impedance state.

If the operational amplifier 381 is used as the voltage follower circuits 414, 415, 417, 42*b*, first, during one horizontal synchronization period, a HIGH control signal CTR input at the DIS terminal (control terminal CTR) connected to the gate of the analog switch turns the operational amplifier 381 into an operational state. Thus, the operational amplifiers 381 (voltage follower circuits 414, 415, 417, 42*b*) of the buffer circuit 411, the voltage follower circuit 417 of the adjusting circuit 416, and the opposite electrode drive circuit 42 in the tone voltage generating circuit 41 are operated as normal.

Meanwhile, a LOW application voltage input is supplied to the DIS terminal (control terminal CTR), the operational amplifiers 381 (voltage follower circuits 414, 415, 417, 42*b*) of the buffer circuit 411, the voltage follower circuit 417 of the adjusting circuit 416, and the opposite electrode drive circuit 41 in the tone voltage generating circuit 41 are stopped. During non-operational periods, current consumption in the operational amplifiers 381 (voltage follower circuits 414, 415, 417, 42*b*) is cut, and the output stage turns into a high impedance state.

Figure 11:
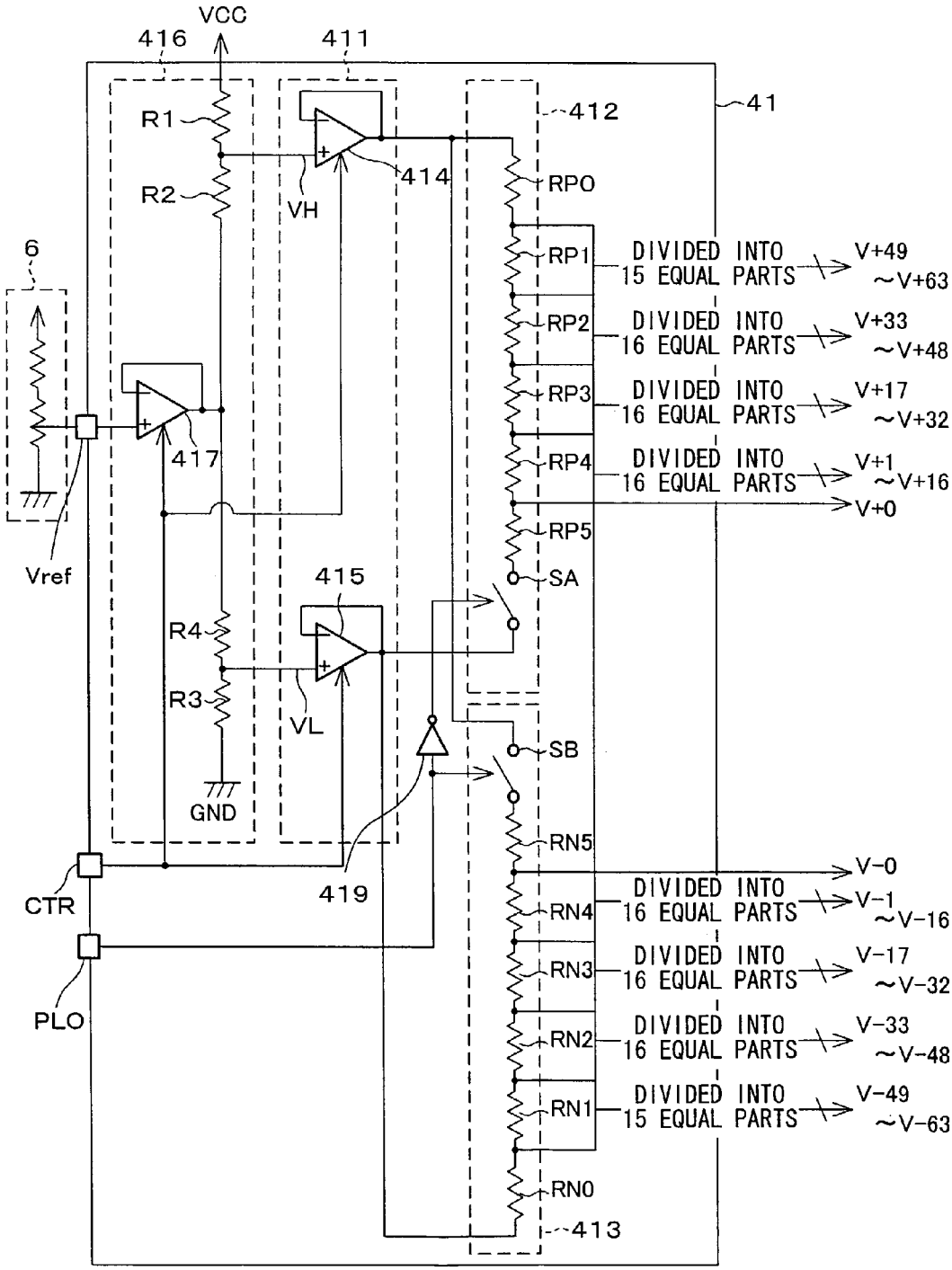
FIG. 11 is a circuit diagram showing a circuit arrangement of a tone voltage generating circuit in the source driver in FIG. 10.
Figure 12:
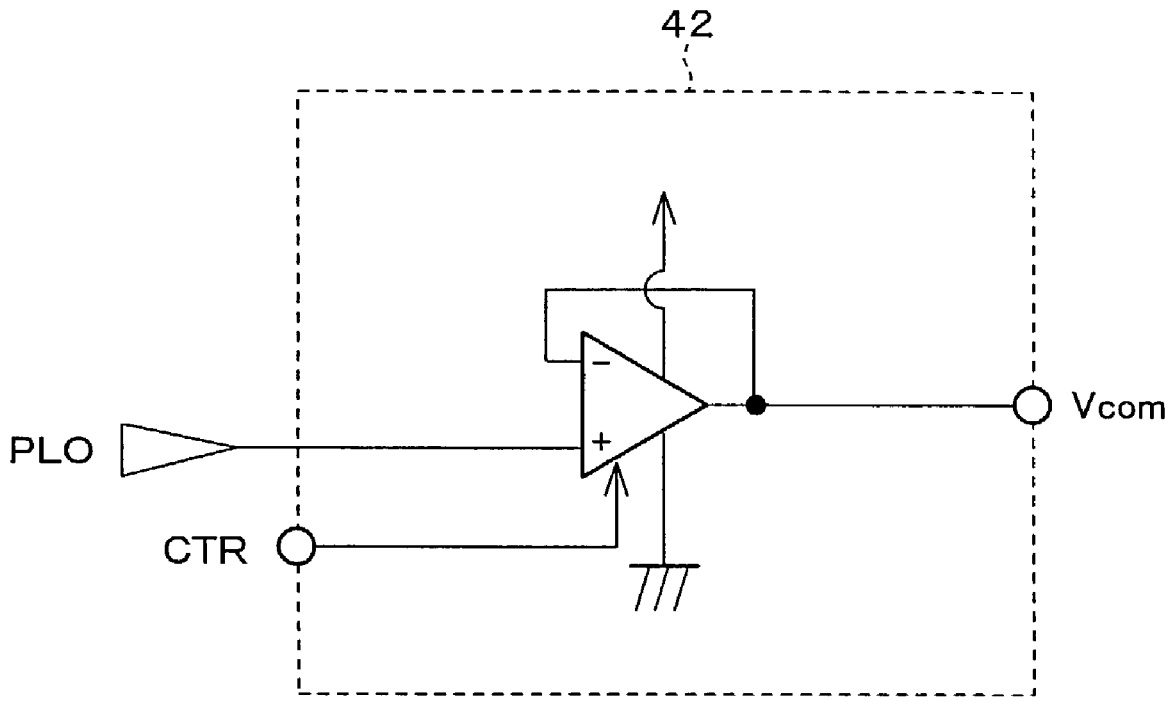
FIG. 12 is a circuit diagram showing a circuit arrangement of an opposite electrode drive circuit in a source driver in FIG. 10.

FIGS. 11, 12 show examples of the aforementioned tone voltage generating circuit 41 and opposite electrode drive circuit 42.

The voltage follower circuits 414, 415, 417, 42*b* is preferably activated/deactivated in the following manner as an example. For example, power consumption by the voltage follower circuits 414, 415, 417, 42*b* can be reduced by such controls that when a constant time TI (TI is presumed to be a value in one horizontal period) has elapsed, and the pixel capacitors (liquid crystal) have completed charging/discharging, a control signal to turn the operation of the voltage follower circuits 414, 415, 417, 42*b* into a stopped state is input or the operation of the voltage follower circuits 414, 415, 417, 21*b* is stopped during a vertical synchronization blanking period.

Alternatively, in liquid crystal displays mounted to mobile telephone and other mobile devices, it is also effective to stop the operation of the voltage follower circuits 414, 415, 417, 42*b* during standby times or when a scan signal is stopped to turn off the TFTs and electric charge is held during a standby time. This also can reduce power consumption.

A display driving device of the present invention is, as described so far, is arranged to include:

a tone voltage generator for generating as many standard voltages as tones; and a digital-to-analog converter for selecting one of the standard voltages in accordance with display data and outputting the selected standard voltage as a tone display voltage, the tone voltage generator including:

a standard voltage generator for generating as many standard voltages as tones, the standard voltages having voltage values between an upper limit voltage and a lower limit voltage; and an upper/lower limit voltage generator for generating the upper limit voltage and the lower limit voltage, wherein the upper/lower limit voltage generator is arranged to be fed with an input voltage regulated by an external voltage regulator and to vary both the upper limit voltage and the lower limit voltage in accordance with an identical input voltage.

According to the arrangement, by adjusting the input voltage using the external voltage regulator, the γ characteristics for a display can be readily adjusted in accordance with the characteristics of the display panel without bothering to remake the display driving device. Further, According to the arrangement, the upper limit voltage and the lower limit voltage is adjusted, and the range of the standard voltage can be adjusted, based on a common external voltage; the externally supplied voltage is small, the number of input terminals can be small, and the circuit arrangement can be simplified.

The upper/lower limit voltage generator is preferably arranged to keep the difference between the upper limit voltage and the lower limit voltage constant.

According to the arrangement, the difference between the upper limit voltage and the lower limit voltage is kept constant; the contrast of the image displayed on the display panel can be kept substantially constant. Consequently, the γ characteristics can be readily adjusted in accordance with the characteristics of the display panel while avoiding flickering on the screen from being easily perceived due to too high or low a contrast. In other words, according to the arrangement, the γ characteristics can be readily adjusted while avoiding flickering due to too high or low a contrast, because the contrast of the display image can be kept substantially constant.

The upper/lower limit voltage generator preferably includes: a first voltage divider for generating an upper limit voltage from an input voltage and a power source voltage by voltage division; and a second voltage divider for generating a lower limit voltage from an input voltage and a fixed voltage (ground potential or other power source voltage) which differs from the power source voltage by voltage division. Further, the first and second voltage dividers are preferably arranged by resistance division.

Preferably, the upper/lower limit voltage generator includes first through fourth resistors connected in series between a power source and a ground potential, an input voltage from an external voltage regulator is supplied to a node between the second resistor and the third resistor, an upper limit voltage is generated at a node between the first resistor the second resistor, and a lower limit voltage is generated at a node between the third resistor and the fourth resistor, wherein resistance values are specified so that R1:R2=R3:R4 where R1 is the resistance value of the first resistor, R2 is the resistance value of the second resistor, R3 is the resistance value of the fourth resistor, and R4 is the resistance value of the third resistor.

According to the arrangement, the upper limit voltage and the lower limit voltage can be generated in stable fashion in accordance with an input voltage by resistance division, and the difference between the upper limit voltage and the lower limit voltage can be readily kept constant.

A display driving device of the present invention is preferably arranged so that the standard voltage generator generates as many standard voltages as tones by resistance division and that a first buffer for buffering the upper limit voltage and the lower limit voltage intervenes between the upper/lower limit voltage generator and the standard voltage generator.

According to the arrangement, the upper limit voltage and the lower limit voltage is low-impedance converted and supplied to the standard voltage generator; variations in the voltage during the charging/discharging of the pixels in the display panel can be eliminated, and the standard voltage can be stabilized. In addition, the value o the electric current flow through the standard voltage generator can be restrained, and power consumption can be reduced.

The first buffer may be adapted so as to start/stop operation in accordance with an externally supplied control signal.

According to the arrangement, power consumption can be further reduced by stopping the operation of the first buffer when the first buffer does not need to operate.

A display driving device of the present invention is preferably arranged to further include an opposite electrode drive circuit for driving an opposite electrode of the display panel using a power source voltage supplied from a power source, the opposite electrode drive circuit including a second buffer buffering the power source voltage, and the second buffer being capable of start/stop operation in accordance with an externally supplied control signal.

According to the arrangement, the second buffer can convert the power source voltage into a low-impedance voltage, and power consumption can be further reduced by stopping the operation of the second buffer when the second buffer does not need to operate.

A display driving device of the present invention is preferably arranged to further include an opposite electrode drive circuit for driving an opposite electrode of the display panel, at least the tone voltage generator, the digital-to-analog converter, and the opposite electrode drive circuit being fabricated into a single integrated circuit.

According to the arrangement, the tone voltage generator, the digital-to-analog converter, etc. conventionally fabricated in a source driver IC and the opposite drive electrode circuit conventionally fabricated in an IC other than the source driver IC are fabricated in a single IC; the display driving device can be made compact. Further, a display can be hence made compact.

A display driving device of the present invention is preferably arranged so that the standard voltage generator further includes a positive standard voltage generator generating as many positive polarity standard voltages as tones and a negative standard voltage generator generating as negative polarity standard voltages as tones and that the tone voltage generator includes a switching unit for turning either one of the positive and negative standard voltage generators into an operational state and the other into a non-operational state in accordance with a polarity inversion cycle of the tone display voltage.

According to the arrangement, the operation of either one of the positive and negative standard voltage generators is stopped; the through current through the standard voltage generator can be restricted. As a result, a low power-consuming display driving device can be provided.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A display driving device for applying, to data signal lines of an active matrix display panel, a tone display voltage inverted in polarity at a predetermined cycle and modulated in accordance with display data, said display driving device comprising:

a tone voltage generator for generating as many standard voltages as tones, a selector circuit for selecting a group of standard voltages from two groups of the generated standard voltages, and a digital-to-analog converter for selecting one of the standard voltages in the group in accordance with display data and outputting the selected standard voltage as a tone display voltage, the tone voltage generator comprising, a standard voltage generator for generating as many standard voltages as tones, the standard voltages having voltage values between an upper limit voltage and a lower limit voltage, and an upper/lower limit voltage generator for generating the upper limit voltage and the lower limit voltage, wherein the standard voltage generator generates as many standard voltages as tones using or based on the upper and lower limit voltage generated by the upper/lower limit voltage generator, the upper/lower limit voltage generator is arranged to be fed with an input voltage regulated by an external voltage regulator and to vary both the upper limit voltage and the lower limit voltage in accordance with an identical input voltage, and the two groups have polarities opposite to each other.

2. The display driving device as defined in claim 1, wherein the upper/lower limit voltage generator is adapted to keep constant a difference between the upper limit voltage and the lower limit voltage.

3. The display driving device as defined in claim 1, wherein the upper/lower limit voltage generator comprises:

a first voltage divider for generating the upper limit voltage from an input voltage and a power source voltage by voltage division; and a second voltage divider for generating the lower limit voltage from an input voltage and a fixed voltage which differs from the power source voltage by voltage division.

4. The display driving device as defined in claim 2, wherein:

the upper/lower limit voltage generator comprises first through fourth resistors connected in series between two electric potential points kept at differing electric potentials;

an input voltage from an external voltage regulator is supplied to a first node between the second resistor and the third resistor, an upper limit voltage is generated at a second node between the first resistor and the second resistor, and a lower limit voltage is generated at a third node between the third resistor and the fourth resistor; and resistance values of the first through fourth resistors are specified so that R1:R2=R3:R4, where R1 is the resistance value of the first resistor, R2 is the resistance value of the second resistor, R3 is the resistance value of the fourth resistor, and R4 is the resistance value of the third resistor.

5. The display driving device as defined in claim 4, wherein the first through fourth resistors are connected in series between a power source and a ground potential.

6. The display driving device as defined in claim 1, wherein:

the standard voltage generator generates as many standard voltages as tones by resistance division; and a first buffer for buffering the upper limit voltage and the lower limit voltage intervenes between the upper/lower limit voltage generator and the standard voltage generator.

7. The display driving device as defined in claim 6, wherein the first buffer is made capable of starting/stopping operation in accordance with an externally provided control signal.

8. The display driving device as defined in claim 6, wherein the first buffer comprises a voltage follower circuit.

9. The display driving device as defined in claim 1, further comprising an opposite electrode drive circuit for driving an opposite electrode in the display panel using a power source voltage supplied from a power source, wherein the opposite electrode drive circuit comprises a second buffer buffering the power source voltage.

10. The display driving device as defined in claim 9, wherein the second buffer is made capable of starting/stopping operation in accordance with an externally provided control signal.

11. The display driving device as defined in claim 9, wherein the second buffer comprises a voltage follower circuit.

12. The display driving device as defined in claim 1, wherein:

the upper/lower limit voltage generator comprises first through fourth resistors connected in series; and a third buffer for buffering the input voltage intervenes between an input terminal where an input voltage regulated by the external voltage regulator is input and the first through fourth resistors.

13. The display driving device as defined in claim 12, wherein the third buffer is made capable of starting/stopping operation in accordance with an externally provided control signal.

14. The display driving device as defined in claim 12, wherein the third buffer comprises a voltage follower circuit.

15. The display driving device as defined in claim 1, further comprising an opposite electrode drive circuit for driving an opposite electrode in the display panel, wherein at least the tone voltage generator, the digital-to-analog converter, and the opposite electrode drive circuit are fabricated into a single integrated circuit.

16. The display driving device as defined in claim 1, wherein:

the standard voltage generator comprises a positive standard voltage generator generating as many positive polarity standard voltages as tones and a negative standard voltage generator generating as many negative polarity standard voltages as tones, the tone voltage generator further comprises a switching unit for turning either one of the positive standard voltage generator and the negative standard voltage generator into an operational state and the other into a non-operational state according to a polarity inversion cycle of the tone display voltage.

17. The display driving device as defined in claim 16, wherein the switching unit comprises:

a first analog switch, provided to the positive standard voltage generator, where a polarity inversion signal is input;

a second analog switch provided to the negative standard voltage generator; and an inverter for inverting a polarity of the polarity inversion signal and supplying the polarity inversion signal to the analog switch.

18. A display, comprising:

an active matrix display panel including data signal lines;

a display driving device applying, to the data signal lines of the display panel, a tone display voltage inverted in polarity at a predetermined cycle and modulated in accordance with display data; and an external voltage regulator supplying the input voltage to the display driving device and being capable of adjusting the input voltage; the display driving device comprising, a tone voltage generator for generating as many standard voltages as tones, a selector circuit for selecting a group of standard voltages from two groups of the generated standard voltages, and a digital-to-analog converter for selecting one of the standard voltages in the group in accordance with display data and outputting the selected standard voltage as a tone display voltage, the tone voltage generator comprising, a standard voltage generator for generating as many standard voltages as tones, the standard voltages having voltage values between an upper linilt voltage and a lower limit voltage, and an upper/lower limit voltage generator for generating the upper limit voltage and the lower limit voltage, wherein the standard voltage generator generates as many standard voltages as tones using or based on the upper and lower limit voltage generated by the upper/lower limit voltage generator, the upper/lower limit voltage generator is adapted to be fed with the input voltage regulated by the external voltage regulator and vary both the upper limit voltage and the lower limit voltage in accordance with an identical input voltage, and the two groups have polarities opposite to each other.

19. The display driving device of claim 1, wherein the external voltage regulator is disposed external to the tone voltage generator.

20. The display of claim 18, wherein the external voltage regulator is disposed external to the tone voltage generator.

21. A display, comprising:

an active matrix display panel provided with data signal lines;

a display driving device for (i) generating, in accordance with an input voltage, a tone display voltage inverted in poiarity at a predetermined cycle, the tone display voltage being modulated in accordance with display data, and (ii) applying the tone display voltage to the data signal lines; and an external voltage regulator disposed external to the display driving device, for supplying the input voltage to the display driving device, wherein the external voltage regulator is capable of adjusting the input voltage, the display driving device shifts a range of the tone display voltage in accordance with a value of the input voltage adjusted by the external voltage regulator, and the display driving device comprising:

a tone voltage generator for generating as many standard voltages as tones;

a selector circuit for selecting a group of standard voltages from two groups of the generated standard voltages; and a digital-to-analog converter for selecting one of the standard voltages as the tone display voltage, the tone voltage generator comprising, an upper/lower limit voltage generator configured to be fed with the input voltage regulated by the external voltage regulator, configured to generate an upper limit voltage and a lower limit voltage, and configured to vary both the upper limit voltage and the lower limit voltage in accordance with an identical input voltage, and a standard voltage generator for generating as many standard voltages as tones using or based on the upper and lower limit voltage generated by the upper/lower limit voltage generator, the standard voltages having voltage values between the upper limit voltage and the lower limit voltage, and the two groups have polarities opposite to each other.

22. A display driving device for applying, to data signal lines of an active matrix display panel, a tone display voltage inverted in polarity at a predetermined cycle and modulated in accordance with display data, said display driving device comprising:

a tone voltage generator for generating as many standard voltages as tones; and a digital-to-analog converter for selecting one of the standard voltages in accordance with display data and outputting the selected standard voltage as a tone display voltage, the tone voltage generator comprising:

a standard voltage generator for generating as many standard voltages as tones, the standard voltages having voltage values between an upper limit voltage and a lower limit voltage; and an upper/lower limit voltage generator for generating the upper limit voltage and the lower limit voltage, wherein the upper/lower limit voltage generator is arranged to be fed with an input voltage regulated by an external voltage regulator and to vary both the upper limit voltage and the lower limit voltage in accordance with an identical input voltage, and wherein the upper/lower limit voltage generator comprises, a first voltage divider for generating the upper limit voltage from an input voltage and a power source voltage by voltage division; and a second voltage divider for generating the lower limit voltage from an input voltage and a fixed voltage which differs from the power source voltage by voltage division.

23. A display driving device for applying, to data signal lines of an active matrix display panel, a tone display voltage inverted in polarity at a predetermined cycle and modulated in accordance with display data, said display driving device comprising:

a tone voltage generator for generating as many standard voltages as tones; and a digital-to-analog converter for selecting one of the standard voltages in accordance with display data and outputting the selected standard voltage as a tone display voltage, the tone voltage generator comprising, a standard voltage generator for generating as many standard voltages as tones, the standard voltages having voltage values between an upper limit voltage and a lower limit voltage; and an upper/lower limit voltage generator for generating the upper limit voltage and the lower limit voltage, wherein the upper/lower limit voltage generator is arranged to be fed with an input voltage regulated by an external voltage regulator and to vary both the upper limit voltage and the lower limit voltage in accordance with an identical input voltage, and wherein the standard voltage generator comprises, a positive standard voltage generator generating as many positive polarity standard voltages as tones and a negative standard voltage generator generating as many negative polarity standard voltages as tones, and a switching unit for turning either one of the positive standard voltage generator and the negative standard voltage generator into an operational state and the other into a non-operational state according to a polarity inversion cycle of the tone display voltage.

* * * * *